US009772601B2

(12) United States Patent
Kichise et al.

(10) Patent No.: US 9,772,601 B2
(45) Date of Patent: Sep. 26, 2017

(54) IMAGE FORMING APPARATUS AND PROCESS UNIT

(71) Applicants: Mitsutoshi Kichise, Osaka (JP); Takeshi Yamashita, Osaka (JP); Kazuki Matsumoto, Kanagawa (JP); Emi Kita, Kanagawa (JP); Naoki Nakatake, Tokyo (JP); Takeshi Sakashita, Tokyo (JP); Takuya Akiyama, Kanagawa (JP)

(72) Inventors: Mitsutoshi Kichise, Osaka (JP); Takeshi Yamashita, Osaka (JP); Kazuki Matsumoto, Kanagawa (JP); Emi Kita, Kanagawa (JP); Naoki Nakatake, Tokyo (JP); Takeshi Sakashita, Tokyo (JP); Takuya Akiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/223,189

(22) Filed: Jul. 29, 2016

(65) Prior Publication Data

US 2017/0031310 A1 Feb. 2, 2017

(30) Foreign Application Priority Data

Jul. 29, 2015 (JP) ..... 2015-149792
Nov. 13, 2015 (JP) ..... 2015-222929
Mar. 14, 2016 (JP) ..... 2016-049773

(51) Int. Cl.
*G03G 21/18* (2006.01)
*G03G 21/00* (2006.01)
*G03G 21/16* (2006.01)

(52) U.S. Cl.
CPC ..... *G03G 21/1814* (2013.01); *G03G 21/0029* (2013.01); *G03G 21/1666* (2013.01);
(Continued)

(58) Field of Classification Search
CPC ..... G03G 21/1814; G03G 21/1821; G03G 21/1666; G03G 21/0029;
(Continued)

(56) References Cited

U.S. PATENT DOCUMENTS 8,280,276 B2 * 10/2012 Sameshima ..... G03G 21/1647 399/110
2002/0149664 A1 * 10/2002 Nagamine ..... B41J 25/308 347/138
(Continued)

FOREIGN PATENT DOCUMENTS

JP 61-120181 6/1986
JP 2004-045571 2/2004
(Continued)

*Primary Examiner* — Ryan Walsh
(74) *Attorney, Agent, or Firm* — Harness, Dickey & Pierce, P.L.C.

(57) ABSTRACT

A process unit includes a rotatable image bearer, an optical writing head to expose the image bearer within an maximum exposure range in an axial direction of the image bearer, a developer bearer, spacers disposed in axial end portions of the image bearer to determine a position of the optical writing head relative to the image bearer and slidingly contact the image bearer, a cleaner disposed downstream from the developer bearer in an image bearer rotation direction, and a remover to slidingly contact the axial end portion of the image bearer to remove a substance adhering thereto. In the axial direction, inner ends of the spacers are positioned inside a toner layer range of the developer bearer extending beyond a largest sheet width. The remover is disposed downstream from the cleaner and crossing a line extending from the inner end of the spacer perpendicularly to the axial direction.

9 Claims, 22 Drawing Sheets

(52) U.S. Cl.
CPC . *G03G 21/1821* (2013.01); *G03G 2215/0402* (2013.01); *G03G 2215/0404* (2013.01); *G03G 2215/0407* (2013.01); *G03G 2221/0015* (2013.01); *G03G 2221/0026* (2013.01); *G03G 2221/1636* (2013.01)

(58) Field of Classification Search
CPC ... G03G 2215/0402; G03G 2215/0407; G03G 2215/0404; G03G 2221/0015; G03G 2221/0026; G03G 2221/1636
See application file for complete search history.

(56) References Cited

U.S. PATENT DOCUMENTS

| | | | | |
|---|---|---|---|---|
| 2007/0064082 | A1* | 3/2007 | Nozawa | G03G 15/326 347/138 |
| 2008/0025752 | A1* | 1/2008 | Suyama | G03G 15/326 399/98 |
| 2015/0035928 | A1* | 2/2015 | Nakamura | G03G 21/1666 347/118 |
| 2015/0117901 | A1 | 4/2015 | Kichise et al. | |
| 2016/0026111 | A1* | 1/2016 | Arasawa | G03G 15/04054 347/118 |
| 2016/0334737 | A1* | 11/2016 | Kichise | G03G 15/161 |
| 2017/0031273 | A1* | 2/2017 | Yamashita | G03G 15/0898 |

FOREIGN PATENT DOCUMENTS

| | | |
|---|---|---|
| JP | 2004-252030 | 9/2004 |
| JP | 2005-141109 | 6/2005 |
| JP | 2015-031708 | 2/2015 |
| JP | 2015-108645 | 6/2015 |

* cited by examiner

IMAGE FORMING APPARATUS AND PROCESS UNIT

CROSS-REFERENCE TO RELATED APPLICATIONS

This patent application is based on and claims priority pursuant to 35 U.S.C. §119(a) to Japanese Patent Application Nos. 2015-149792 filed on Jul. 29, 2015, 2015-222929 filed on Nov. 13, 2015, and 2016-049773 filed on Mar. 14, 2016 in the Japan Patent Office, the entire disclosure of each of which is hereby incorporated by reference herein.

BACKGROUND

Technical Field

Embodiments of the present disclosure generally relate to a process unit that includes a remover to remove a substance adhering to a photoconductor and an image forming apparatus, such as a copier, a printer, a facsimile machine, or a multifunction peripheral including at least two of copying, printing, facsimile transmission, plotting, and scanning capabilities, that includes the process unit.

Description of the Related Art

There are image forming apparatuses such as printers, copiers, facsimile machines, and multifunction peripherals (MFPs) that include a photoconductor, serving as an image bearer to bear an electrostatic latent image and a toner image, and a cleaning blade to remove toner remaining on the photoconductor after the toner image is transferred from the photoconductor. Sheets of paper used as recording media leave paper dust and talc on the photoconductor. In an area adjacent to an end of a sheet area on the photoconductor in the axial direction of the photoconductor, substances including the paper dust as well as the talc, toner, and silica or the like released from the toner (i.e., foreign substances) are likely to firmly adhere. The length of the sheet area on the photoconductor in the axial direction corresponds to a largest sheet width that the image forming apparatus accommodates.

In removing such adhering substances with the cleaning blade, it is possible that an edge of the cleaning blade is damaged and the adhering substances escape the cleaning blade. Then, in the area adjacent to the end of the maximum sheet width, the adhering substances cause streaks or granular images.

SUMMARY

In an embodiment, a process unit includes an image bearer to rotate and bear an electrostatic latent image and a toner image, an optical writing head to expose a surface of the image bearer to form the electrostatic latent image inside a maximum exposure range, which is positioned inside a largest sheet width in an axial direction of the image bearer, a developer bearer disposed opposite the image bearer to supply toner to the image bearer to form the toner image, a pair of spacers disposed in axial end portions of the image bearer and interposed between the optical writing head and the image bearer to determine a position of the optical writing head relative to the image bearer, a cleaner disposed downstream from the developer bearer in a rotation direction of the image bearer to remove the toner from the surface of the image bearer, and a remover disposed downstream from the cleaner in the rotation direction of the image bearer and on at least one of the axial end portions of the image bearer. The developer bearer has a toner layer range extending beyond the largest sheet width in the axial direction. Inner ends of the spacers face each other in the axial direction of the image bearer and positioned inside the toner layer range in the axial direction. The spacers slidingly contact the surface of the image bearer. The remover is disposed crossing an extension line (EX1) extending from the inner end of the spacer in a direction perpendicular to the axial direction. The remover slidingly contacts the surface of the image bearer to remove a substance adhering to the surface of the image bearer.

In another embodiment, an image forming apparatus includes the process unit described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
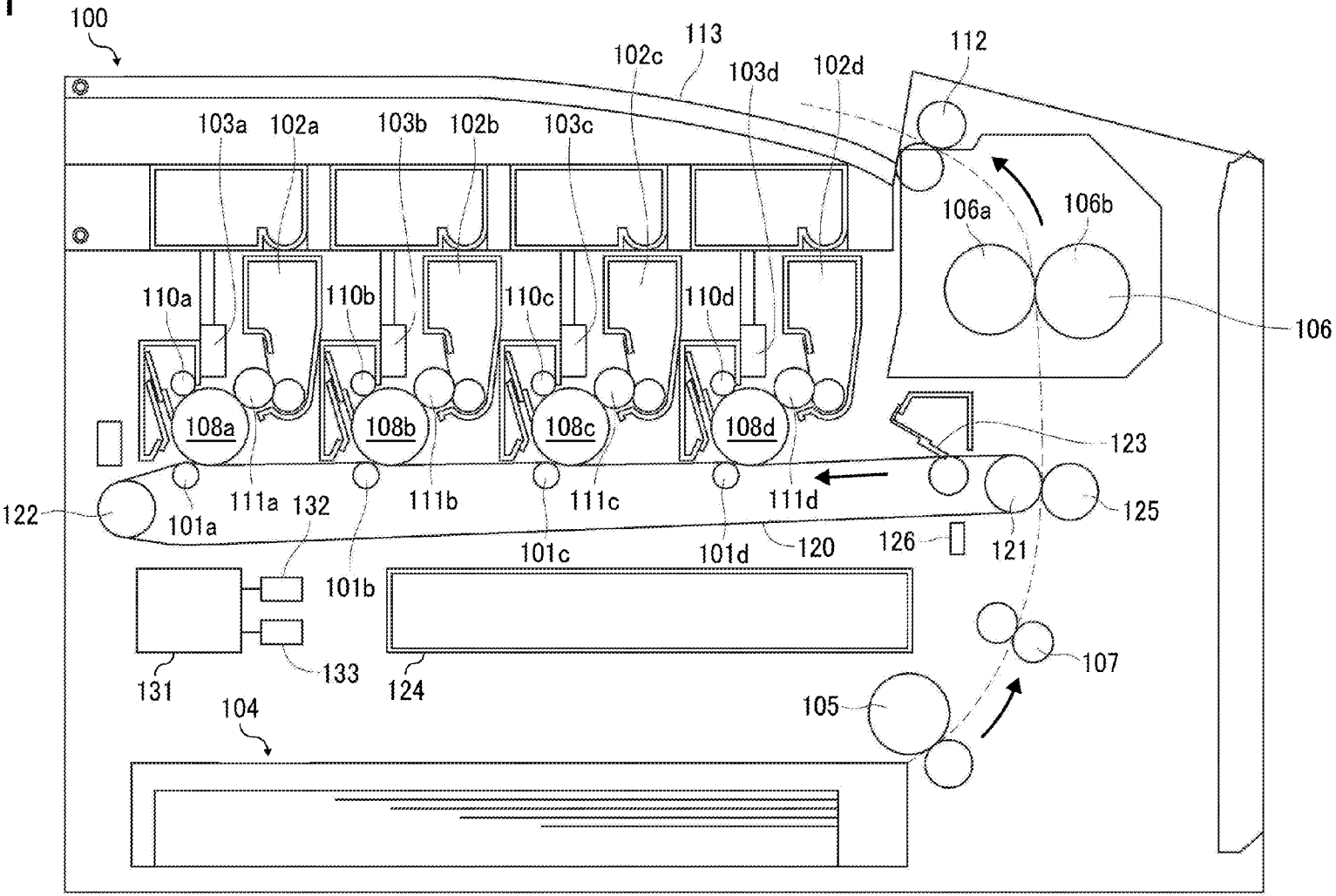
FIG. 1 is a schematic view of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

In the description below, like reference numerals designate identical or corresponding parts throughout the several views thereof, and redundant descriptions are omitted.

Structure of an Image Forming Apparatus

FIG. 1 is a schematic view of an electrophotographic image forming apparatus incorporating a residual substance remover according to the present embodiment. An image forming apparatus 100 illustrated in FIG. 1 is a multicolor image forming apparatus employing a tandem system.

In a body of the image forming apparatus 100, a process unit 102*a* for black images (or monochrome images) and process units 102*b*, 102*c*, and 102*d* for colors such as cyan, magenta, and yellow are mounted. It is to be noted that the subscripts a, b, c, and d attached to the end of reference numerals indicate that components indicated thereby relate to image formation of black, cyan, magenta, and yellow, respectively. In the description below, the subscripts a, b, c, and d are omitted when components common among different colors are referred to.

Figure 2:
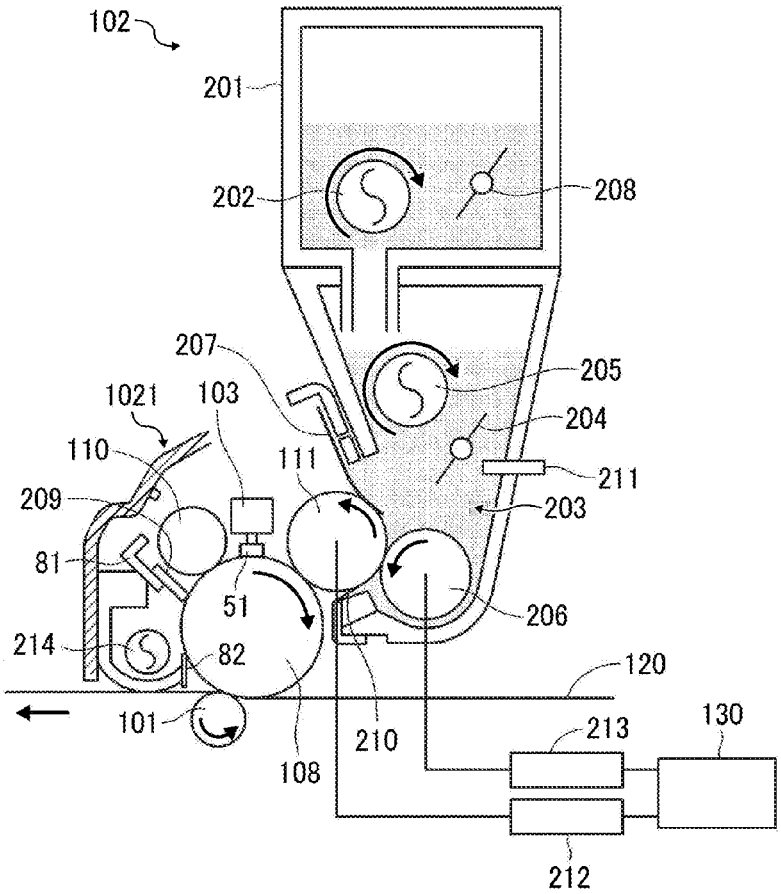
FIG. 2 is a schematic view of a process unit included in the image forming apparatus illustrated in FIG. 1.

Inside the apparatus body, optical writing heads 103*a*, 103*b*, 103*c*, and 103*d* (collectively "optical writing heads 103"), transfer rollers 101*a*, 101*b*, 101*c*, and 101*d* (collectively "transfer rollers 101"), a sheet feeding tray 104, and a fixing device 106 are disposed. Each of the process units 102*a*, 102*b*, 102*c*, and 102*d* (collectively "process units 102") includes an exterior case 1021 as illustrated in FIG. 2, and a photoconductor 108 and the like are disposed in the exterior case 1021. The photoconductor 108 is cylindrical and configured to rotate clockwise in FIG. 1, for example, at a linear speed of 150 mm/s.

Figure 3A:
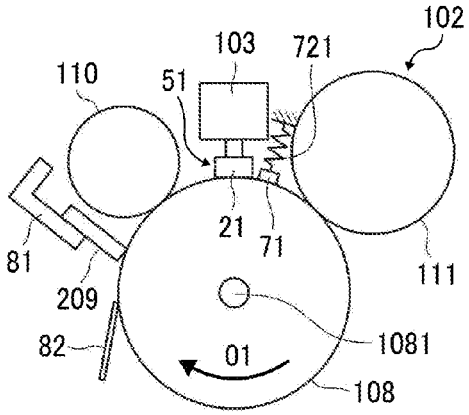
FIGS. 3A and 3B are schematic cross-sectional views of the process unit illustrated in FIG. 2, which includes a residual substance remover according to an embodiment.
Figure 3B:
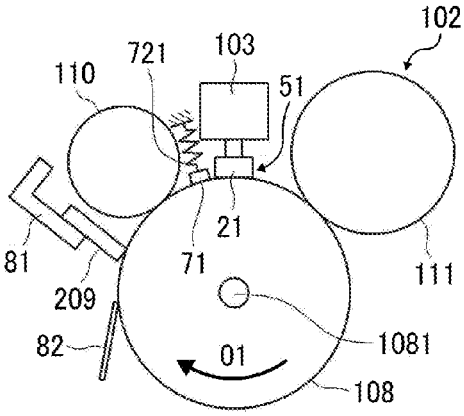
Figure 4:
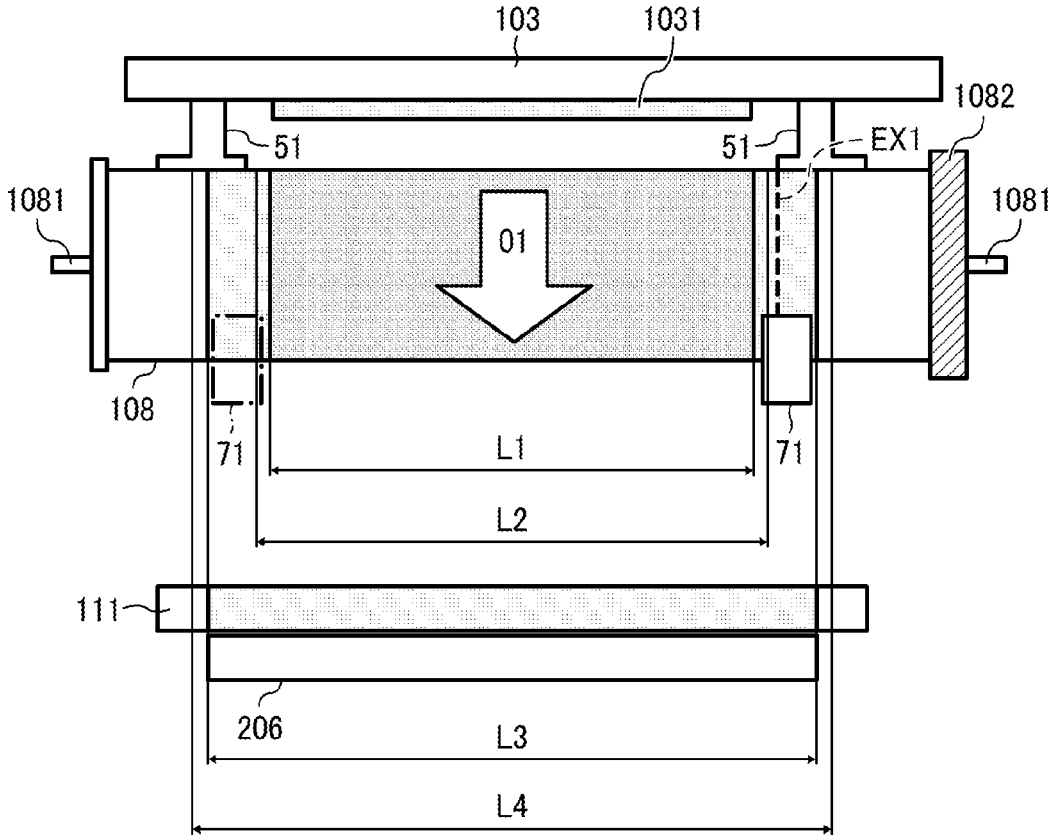
FIG. 4 is a schematic diagram illustrating positioning of an optical writing head using spacers according to an embodiment.

As illustrated in FIGS. 3A, 3B, and 4, shafts 1081 are disposed at both ends of the photoconductor 108. The shafts 1081 project outside the exterior case 1021 and rotatably supported by bearings disposed in the body of the image forming apparatus 100 (hereinafter "apparatus body"). A driven gear 1082 attached to one end of the photoconductor 108 meshes with a drive gear coupled to a motor shaft disposed in the apparatus body.

As illustrated in FIGS. 2, 3A, and 3B, a charging roller 110 (110*a*, 110*b*, 110*c*, or 110*d* in FIG. 1) serving as a charger is pressed against the surface of the photoconductor 108. As the photoconductor 108 rotates, the charging roller 110 rotates. A high-pressure power source applies a charging bias, which is either a direct current (DC) bias or a superimposed bias including a DC component and an alternating current (AC) component, to the charging roller 110. Then, the charging roller 110 charges the photoconductor 108 to have an almost uniform surface potential, thereby initializing the photoconductor 108.

The optical writing head 103 exposes the photoconductor 108 to write an electrostatic latent image on the photoconductor 108 according to image data. The electrostatic latent image includes a low potential portion, in which the potential is attenuated by the exposure, and a high potential portion, in which the potential is increased by the initialization. Around the photoconductor 108, a developing roller 111 (111*a*, 111*b*, 111*c*, or 111*d* in FIG. 1) serving as a developer bearer is disposed, and a high-pressure power source is coupled to the developing roller 111.

A predetermined developing bias supplied from the high-pressure power source causes toner to move to the low potential portion of the electrostatic latent image on the photoconductor 108. Then, the electrostatic latent image is visualized and becomes a toner image. For example, the developing bias has a voltage having a negative potential. Above the developing roller 111, a developing chamber 203 is disposed. The developing chamber 203 contains toner (i.e., one-component developer) for image developing.

The process units 102*a*, 102*b*, 102*c*, and 102*d* are disposed side by side, and an intermediate transfer belt 120 is disposed below the process units 102. The image forming apparatus 100 includes a contact-separation mechanism to engage the intermediate transfer belt 120 with each photoconductor 108 and disengage the photoconductor 108 therefrom.

The intermediate transfer belt 120 is an endless belt made of a resin film produced by, for example, dispersing a conductive material such as carbon black in a material such as polyvinylidene fluoride (PVDF), ethylene tetrafluoroethylene copolymer (ETFE), polyimide (PI), polycarbonate (PC), thermoplastic elastomer (TPE), and the like.

The intermediate transfer belt 120 is entrained around a tension roller 121, a driving roller 122, and the transfer rollers 101. As a driving motor rotates the driving roller 122, the intermediate transfer belt 120 rotates in the direction indicated by an arrow in FIG. 1. A predetermined transfer bias is applied to each transfer roller 101 from a power supply to generate a transfer electrical field.

An image density sensor 126 is disposed adjacent to the tension roller 121, around which the intermediate transfer belt 120 is entrained. The image density sensor 126 is an optical sensor including a specular reflection sensor and a diffuse reflection sensor. The image density sensor 126 detects the level of light reflected on an image and a toner patch transferred on the intermediate transfer belt 120 from the photoconductor 108.

The amount of toner adhering or the density of toner is detected based on the reflected light level. The toner adhesion amount is transmitted to a controller 130, which is described later, so that the controller 130 determines image forming conditions. It is to be noted that, alternatively, the image density sensor 126 can be disposed around the photoconductor 108.

The sheet feeding tray 104 contains recording sheets (i.e., transfer sheets). A sheet feeding roller 105 and a timing roller pair 107 feed the recording sheet to a transfer position between the tension roller 121 and a secondary transfer roller 125, timed to coincide with the arrival to the transfer position of a leading end of the toner image transferred on to the intermediate transfer belt 120 from the photoconductor 108. The secondary transfer roller 125 includes a metal core and a conductive, elastic body overlying the metal core.

In full-color image formation, visible images are formed in the order of yellow, cyan, magenta, and black from the right to the left in FIG. 1. The yellow, cyan, magenta, and black toner images on the respective photoconductors 108 are sequentially transferred onto the intermediate transfer belt 120 at positions where the transfer rollers 101 contact the intermediate transfer belt 120, respectively. Thus, a full-color toner image is formed on the intermediate transfer belt 120.

The toner image is transferred onto the recording sheet at the transfer position between the tension roller 121 and the secondary transfer roller 125. Subsequently, the fixing device 106 applies heat and pressure to the recording sheet to fix the toner image on the recording sheet, after which the recording sheet is discharged from the apparatus.

Downstream from the tension roller 121 in the direction of rotation of the intermediate transfer belt 120, a cleaning blade 123 is disposed to collect residual toner remaining on the intermediate transfer belt 120 after the toner image is transferred from the intermediate transfer belt 120. The collected toner is transported through a toner conveyance passage, such as a tube, and stored in a waste toner container 124.

Each of the optical writing heads 103 includes a light-emitting element 1031, a drive circuit for the light-emitting element 1031, and a lens array to focus the light emitted from the light-emitting element 1031. The light-emitting element 1031 can be either a light-emitting diode (LED) or an organic electro-luminescent (EL) element having a predetermined number of pixels calculated by multiplying an image width with a pixel density (e.g., 1200 dot per inch or dpi). The light-emitting element 1031, the lens array, and the like are incorporated in a housing and constitute the LED head or the organic EL head.

The light-emitting element 1031 emits light according to image signals to form latent images on the photoconductor 108. To efficiently attain a light emission intensity, the lens array has an increased number of openings, and a focal length thereof is short. Accordingly, the optical writing head 103 is disposed close to the photoconductor 108, at about several millimeters from the photoconductor 108, for example.

The housing includes an engaging portion (e.g., a hole, a projection, or a flat mounting face) for attachment of the optical writing head 103. A harness is connected to the optical writing head 103 to supply power and the image signals in accordance with the image data.

The controller 130 is disposed in the body of the image forming apparatus 100. A temperature sensor 132 and a humidity sensor 133 are connected to the controller 130 so that the controller 130 receives the temperature and the humidity detected by the temperature sensor 132 and the humidity sensor 133. The controller 130 is configured to calculate absolute humidity inside the apparatus based on the detected temperature and the detected humidity and calculate the charging bias and the surface potential of the photoconductor 108 based on the absolute humidity.

Although the description above concerns a color image forming apparatus employing a tandem system, various aspects of this disclosure are applicable to four-cycle color image forming apparatuses and monochrome image forming apparatuses. Further, instead of one-component developer, two-component developer can be employed.

Process Unit

FIG. 2 is a schematic cross-sectional view of the process unit 102 serving as an image forming unit.

The process unit 102 includes the developing chamber 203 and a toner container 201 disposed above the developing chamber 203 and containing toner supplied to the developing chamber 203. A predetermined amount of toner is stored in the developing chamber 203 from an initial stage of use. A stirring paddle 208 or the like can be disposed inside the toner container 201 to stir the toner to maintain the flowability of the toner.

On a side of the stirring paddle 208, a conveyor 202 such as a screw and a coil is disposed inside the toner container 201. The conveyor 202 is to be coupled to a driver disposed in the image forming apparatus 100 (hereinafter "apparatus-side driver") via a clutch or the like. The conveyor 202 is driven as required to supply toner to the toner container 201.

The amount of toner supplied can be adjusted with the duration of driving of the apparatus-side driver. For example, the duration of driving is changed to cope with fluctuations in flowability of toner caused by changes in temperature and humidity.

Inside the developing chamber 203 disposed in a lower part of the process unit 102, a toner conveyor 205 such as a screw is disposed to transport the toner, which is supplied from the toner container 201, entirely in the longitudinal direction. Additionally, an agitator 204 is disposed adjacent to the toner conveyor 205 to stir the toner.

A remaining quantity detector 211 detects the level (height) of toner inside the developing chamber 203. The remaining quantity detector 211 can be any of a light transmissive sensor, a piezoelectric sensor, and a mechanical sensor. When the amount of toner remaining in the developing chamber 203 falls to or below the level detected by the remaining quantity detector 211, the toner container 201 supplies the toner to the developing chamber 203.

The developing roller 111 serving as a toner bearer and a supply roller 206 are disposed at a bottom of the developing chamber 203. The supply roller 206 supplies the toner to the developing roller 111. A main component of the supply roller 206 is sponge.

A developing bias source 212 applies a developing bias to the developing roller 111. A supply bias source 213 applies a supply bias to the supply roller 206. The controller 130 controls the developing bias source 212 and the supply bias source 213.

The developing roller 111 is contactless with the photoconductor 108 and contactlessly develops the electrostatic latent image on the photoconductor 108 with toner. Alternatively, the developing roller 111 can be disposed in contact with the photoconductor 108 to perform contact-type development.

The toner supplied to the developing roller 111 from the supply roller 206 is adjusted to a uniform thickness by a regulation blade 207. Subsequently, the toner moves to the photoconductor 108 corresponding to the surface potential of the photoconductor 108, thereby developing the latent image into a toner image. The toner image is then transferred from the photoconductor 108 onto the intermediate transfer belt 120 in the primary transfer nip.

The toner that is not transferred to the photoconductor 108 but remains on the developing roller 111 slidingly contacts a toner leak prevention sheet 210 disposed in a clearance around the developing roller 111. Then, the toner is collected in the developing chamber 203.

The toner that is not transferred from photoconductor 108 but remain thereon passes by a seal 82 and is collected from the photoconductor 108 by a cleaning blade 209 serving as a cleaner. A toner conveyor 214 such as a screw transports the collected toner to the waste toner container 124 inside the image forming apparatus 100. It is to be noted that the cleaning blade 209 contacts the photoconductor 108 in a cleaning blade width L4 illustrated in FIG. 4.

The recording sheet carrying the toner image is transported to the fixing device 106 including a fixing roller 106*a* and a pressure roller 106*b*, which apply heat and pressure to the toner image to fix the toner image on the recording sheet while the sheet P passes through a fixing nip therebetween. Then, a pair of ejection rollers 112 discharges the recording sheet onto an output tray 113.

Spacer for Positioning the Optical Writing Head

As described above, the optical writing head 103 includes a light-emitting diode (LED) or an organic electro-luminescent (EL) element as the light-emitting element 1031. Since the depth of focus of the light-emitting element 1031 is shallow (about 100 μm, for example), the process unit 102 includes spacers 51 to enhance positioning accuracy of the optical writing head 103 relative to the photoconductor 108.

The spacers 51 are described below with reference to FIGS. 3A through 5B.

As illustrated in FIGS. 3A and 3B, the spacers 51 contact the surface of the photoconductor 108 and a bottom face of the optical writing head 103, thereby regulating the position of the optical writing head 103 relative to the photoconductor 108 and defining the distance therebetween. It is to be noted that the configurations illustrated FIGS. 3A and 3B are similar except the position of a residual substance remover 71 described later.

As illustrated in FIG. 4, the optical writing head 103 extends in the axial direction of the photoconductor 108 (i.e., a main scanning direction). Hereinafter, "axial direction" represents the axial direction of the photoconductor 108 unless otherwise specified. The light-emitting element 1031, which is either an LED or an organic EL element and has the predetermined number of pixels (image width×pixel density, e.g., 1200 dpi), is disposed on the bottom of the optical writing head 103 in FIG. 4 to face the photoconductor 108.

The spacer 51 is disposed at each end of the optical writing head 103 in the longitudinal direction of the optical writing head 103 (or the axial direction of the photoconductor 108). Each spacer 51 contacts the bottom face of the optical writing head 103 and the surface of the photoconductor 108. Contacting both the photoconductor 108 and the optical writing head 103, the spacer 51 receives a load in the direction from the optical writing head 103 toward the photoconductor 108 due to a biasing member such as a coil spring 721 illustrated in FIGS. 3A and 3B.

In FIG. 4, in the axial direction of the photoconductor 108, the optical writing head 103 can expose the photoconductor 108 within in a maximum exposure range L1. To suppress wear in the maximum exposure range L1 on the photoconductor 108, the spacers 51, which contact the photoconductor 108, are disposed outside the maximum exposure range L1. It is to be noted that the maximum exposure range L1 means the range within which the optical writing head 103 can expose the surface of the photoconductor 108, and the maximum exposure range L1 is determined by, for example, the width of the width of the LED array.

In the present embodiment, the spacers 51 contact the photoconductor 108 at positions away from each other in the axial direction of the photoconductor 108. Specifically, each spacer 51 includes a linear portion 51*b* and an inclined portion 51*c*, both of which contact the photoconductor 108 at positions away from each other.

Each spacer 51 is disposed avoiding a boundary of the cleaning blade width L4 (i.e., a cleaning range end) on the surface of the photoconductor 108 since the residual substance can firmly adhere to an area around the boundary of the cleaning blade width L4 in a streaky manner (hereinafter "streaky adhesion of residual substance").

That is, the linear portion 51*b* and the inclined portion 51*c* are disposed astride the boundary of the cleaning blade width L4 to inhibit the streaky adhesion of residual substance from entering the clearance between the photoconductor 108 and the spacer 51 (the face contacting the photoconductor 108). Accordingly, the spacers 51 suppress degradation of positioning accuracy of the optical writing head 103 relative to the photoconductor 108 caused by the residual substance embedded between the photoconductor 108 and the spacer 51.

In FIGS. 3A and 4, the residual substance remover 71 is disposed downstream (in the rotation direction of the photoconductor 108) from one of the spacers 51 that is close to the driven gear 1082. The residual substance remover 71 crosses an extension line EX1 (in FIG. 4) extending from the inner end of the spacer 51 in the axial direction of the photoconductor 108. Alternatively, the process unit 102 can includes a pair of residual substance removers 71, and another residual substance remover 71 is disposed downstream from the other spacer 51 as indicated by broken lines in FIG. 4.

Figure 5A:
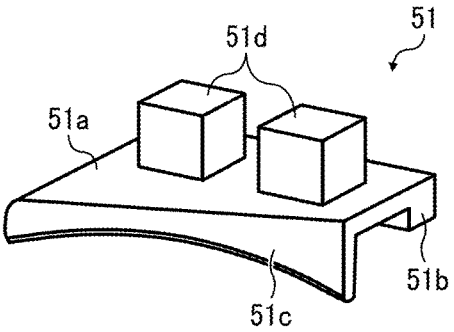
FIGS. 5A and 5B are perspective views of the spacer illustrated in FIG. 4.
Figure 5B:
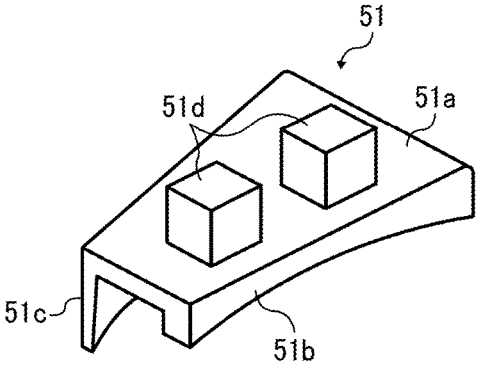
Figure 5C:
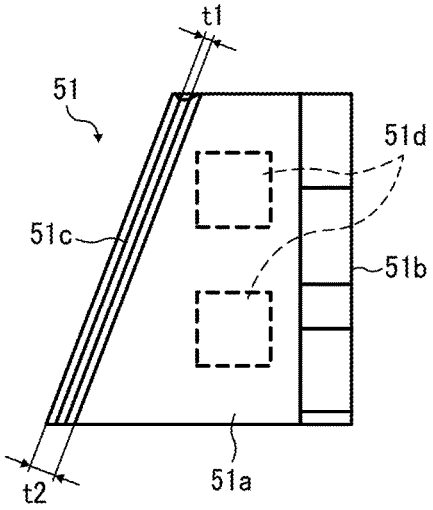
FIG. 5C is a bottom view of the spacer.

FIGS. 5A and 5B are perspective views of the spacer 51, and FIG. 5C is a bottom view of the spacer 51. The spacer 51 further includes a trapezoidal base plate 51*a* and two rib-like legs extending from the base plate 51*a* (a bottom face thereof in FIGS. 5A and 5B) toward the photoconductor 108.

One of the rib-like legs is the linear portion 51*b* extending along the circumference (arc-shape) of the photoconductor 108 perpendicular to the axial direction. The other of the rib-like legs is the inclined portion 51*c* that is inclined from the axial direction of the photoconductor 108 and serves as an inner end of the spacer 51 in the axial direction. The respective inclined portions 51*c* of the two spacers 51 face each other in the axial direction. In other words, the inclined portion 51*c* is disposed inside in the axial direction from the linear portion 51*b*, and the inclined portion 51*c* extends from the inner end of the spacer 51 in the axial direction.

The linear portion 51*b* and the inclined portion 51*c* are at right angle with the base plate 51*a* and extend from sides of the base plate 51*a* except sides parallel to each other. The linear portion 51*b* and the inclined portion 51*c* are at a predetermined distance from each other in the axial direction of the photoconductor 108.

The spacers 51 are disposed, respectively, at the right end and the left end in the axial direction of the photoconductor 108, as a pair. Each spacer 51 further includes one or multiple columnar portions 51*d* disposed on an upper face of the base plate 51*a*. The base plate 51*a* and the columnar portions 51*d* are united into a single component or molded as a single piece. In the present embodiment, the number of the columnar portions 51*d* is different between the two spacers 51 although the spacers 51 are symmetrical in shape.

In the configuration illustrated in FIG. 4, the spacer 51 on the left includes one columnar portion 51*d* and the spacer 51 on the right includes two columnar portions 51*d*. The number of the columnar portions 51*d* on the left and that on the right can be reversed. Each columnar portion 51*d* is disposed close to a center of the base plate 51*a* in the axial direction of the photoconductor 108. The effect of the placement of the columnar portions 51*d* is described later with reference to FIGS. 6A through 7B.

Figure 5D:
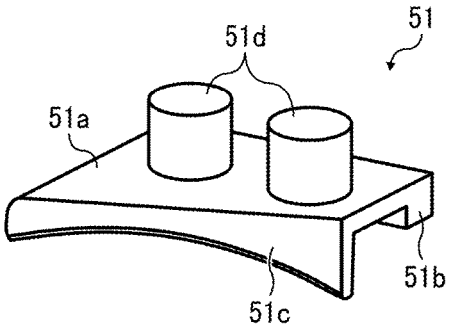
FIGS. 5D and 5E are perspective views of a spacer according to another embodiment, including columnar portions that are cylindrical.
Figure 5E:
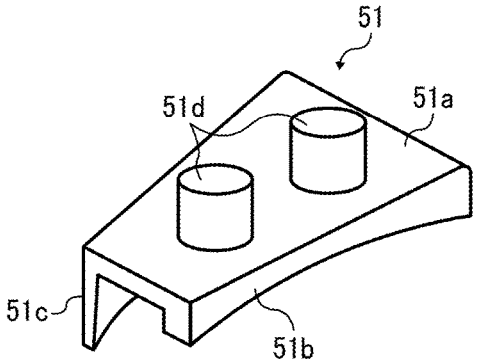
Figure 5F:
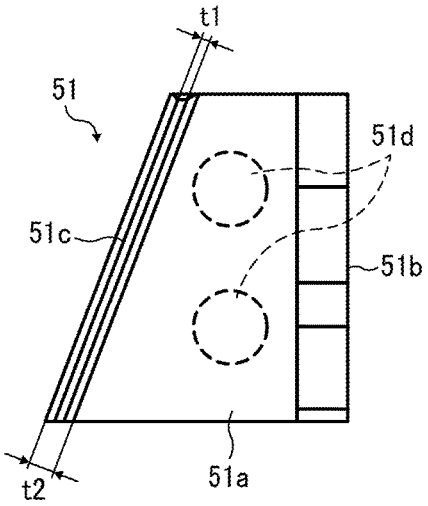
FIG. 5F is a bottom view of the spacer illustrated in FIGS. 5D and 5E.

The spacer 51 illustrated in FIGS. 5A, 5B, and 5C is disposed on the right in FIG. 4 and includes the two columnar portions 51*d* united with or molded together with the base plate 51*a* into a single piece. The three columnar portions 51*d* in total of the right and the left in FIG. 4 are identical in shape and height. The upper end face (in FIGS. 5A and 5B) of each columnar portion 51*d* is parallel to the bottom face (i.e., a contact reference face) of the optical writing head 103. The upper end faces of the three columnar portions 51*d* contact or abut the bottom face of the optical writing head 103. Thus, the posture and the height of the optical writing head 103 relative to the surface of the photoconductor 108 are determined with so-called three-point contact. It is to be noted that, the columnar portions 51*d* are not necessarily prismatic but can be cylindrical as illustrated in FIGS. 5D, 5E, and 5F.

In a state in which the spacer 51 is interposed between the optical writing head 103 and the photoconductor 108, the inclined portion 51*c* and the linear portion 51*b* slidingly contact the surface of the photoconductor 108. As illustrated in FIGS. 5A and 5B, the faces of the inclined portion 51*c* and the linear portion 51*b* that contact the photoconductor 108 are arc-shaped confirming to the surface shape of the photoconductor 108. With the arc-shape, the inclined portion 51*c* and the linear portion 51*b* slide on the photoconductor 108 in stable postures.

The inclined portion 51*c* and the linear portion 51*b* are shaped like ribs extending around the surface of the photoconductor 108. Accordingly, the inclined portion 51*c* and the linear portion 51*b* can elastically deform easily following the surface of the photoconductor 108, thus inhibiting creation of clearance between the photoconductor 108 and the inclined portion 51*c* and the linear portion 51*b*.

In particular, the inclined portion 51*c* is thinner than the linear portion 51*b*. Accordingly, the inclined portion 51*c* deforms to contact the photoconductor 108 more easily. In addition, as illustrated in FIG. 5C, the inclined portion 51*c* has a tip width t1 that is smaller than a root width t2 thereof. Accordingly, the inclined portion 51*c* elastically deforms easily compared with a configuration in which the tip width t1 is similar to the root width t2.

Since the inclined portion 51*c* elastically deforms easily, creation of clearance between the photoconductor 108 and the inclined portion 51*c* is inhibited. Accordingly, blocked by the inclined portion 51*c*, the substances escaping the cleaning blade 209 and remaining on the photoconductor 108 move along the inclination of the inclined portion 51*c*. Thus, the inclined portion 51*c* suppresses adhesion of the substances in the maximum exposure range L1.

Figure 6A:
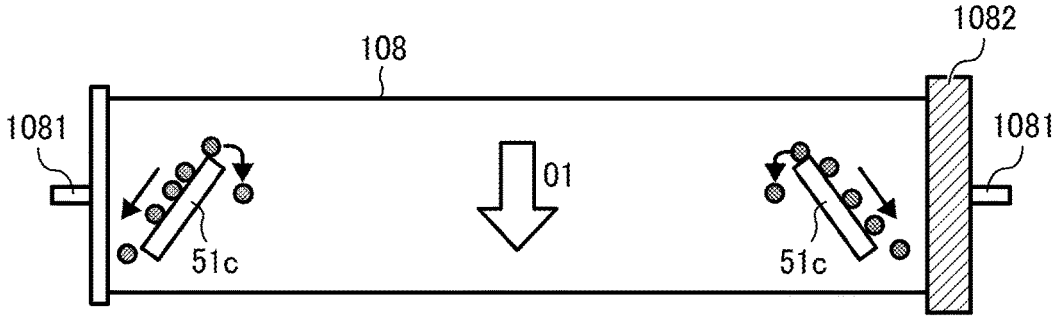
FIGS. 6A and 6B illustrate creation of streaks of substances on a photoconductor, starting at an upstream end of the spacer in the direction of rotation of a photoconductor.
Figure 6B:
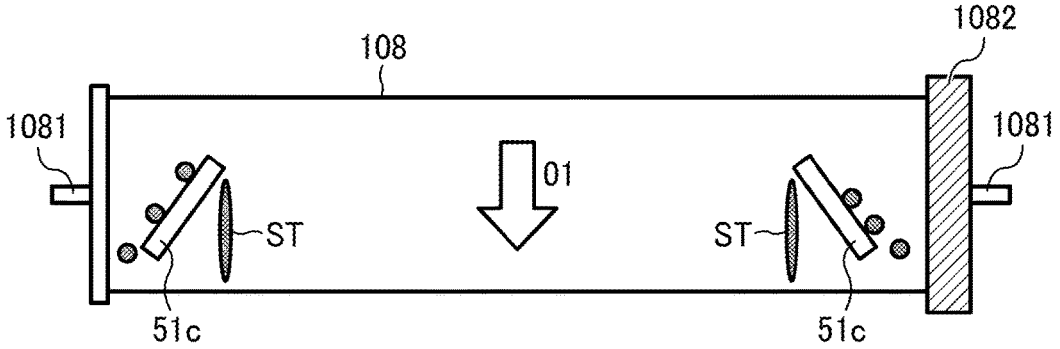

FIGS. 6A and 6B illustrate creation of streaks of substances adhering to the photoconductor 108. As the photoconductor 108 rotates in the direction indicated by arrow 01 (hereinafter "rotation direction 01"), the inclined portion 51*c* of the spacer 51 blocks the residual substances, such as the residual toner, in an axial end area of the photoconductor 108 corresponding to the end of a toner layer range L3 (illustrated in FIG. 4) of the developing roller 111, in which a toner thin layer is formed on the developing roller 111. Then, the inclined portion 51*c* guides the adhering substances outward in the axial direction of the photoconductor 108. However, it is possible that the substances blocked by an upstream end (inner end in the axial direction) of the inclined portion 51*c* (i.e., end portion of the spacer 51) fails to move outward in the axial direction and falls from the upstream end of the inclined portion 51*c* to the inner side in the axial direction as illustrated in FIG. 6A. In this case, the substances adhere to the surface of the photoconductor 108 in the form of streaky adhesion ST extending in the rotation direction 01. The streaky adhesion ST is transferred to an end area of the recording sheet in a sheet width direction (the axial direction of the photoconductor 108), thus creating a steak on the recording sheet. In the present embodiment, the photoconductor 108 is provided with the residual substance remover 71 to remove the streaky adhesion ST.

Residual Substance Remover

Descriptions are given below of a removing device 710 (illustrated in FIG. 9A) including the residual substance remover 71, serving as a remover to remove the residual substance from the photoconductor 108. The residual substance on the photoconductor 108 (to be removed) includes the residual toner, a foreign material as paper dust and talc, and a mixture of toner and the foreign material.

As illustrated in FIGS. 3A and 3B, the residual substance remover 71 is shaped like a rectangular plate and biased to the surface of the photoconductor 108 by the coil spring 721.

The residual substance remover 71 is disposed either downstream from the spacer 51 in the rotation direction 01 of the photoconductor 108 as illustrated in FIG. 3A or upstream from the spacer 51 in the rotation direction 01 as illustrated in FIG. 3B. When the spacer 51 is disposed downstream from the spacer 51 in the rotation direction 01 as illustrated in FIG. 3A, the spacer 51 immediately removes the streaky adhesion ST arising from the upstream end of the spacer 51, thereby enhancing the effect to remove the adhesion from the photoconductor 108.

The residual substance remover 71 slidingly contacts the surface of the photoconductor 108 to scrape off the substances adhering to the photoconductor 108 by polishing. The residual substance remover 71 can contain inorganic particles having a polishing effect such as cerium oxide. Specific examples of inorganic particles include, in addition to cerium oxide, alumina, barium titanate, magnesium titanate, calcium titanate, strontium titanate, zinc oxide, tin oxide, quartz sand, clay, mica, wollastonite, diatom earth, chromium oxide, red iron oxide, antimony trioxide, magnesium oxide, zirconium oxide, barium sulfate, barium carbonate, calcium carbonate, silicon carbide, and silicon nitride. The above-listed inorganic particles are usable as the external additives to improve flowability, developing capability, or chargeability of the toner.

The residual substance remover 71 is shaped into a rectangular plate, for example, in the following method. First, disperse the inorganic particles and resin such as polyurethane in a solvent to prepare a slurry. Examples of the solvent include ketones such as methyl isobutyl ketone, methyl ethyl ketone, and acetone; aromatics such as toluene; esters such as ethyl acetate; and ethers such as tetrahydrofuran.

Apply the slurry to a rectangular frame to a predetermined thickness. Dry the slurry with heat to remove the solvent. Then, the slurry becomes the residual substance remover 71 shaped like a rectangular plate having minute projections on the surface thereof for polishing.

While rubbing on the surface of the photoconductor 108 to scraping off the adhering substances therefrom, the residual substance remover 71 abrades the photoconductor 108 over time. Although the powder arising from the abrasion is mixed with the residual toner, the residual substance remover 71 removes the mixture of the residual toner and the abrasion powder (i.e., residual substances).

Figure 7A:
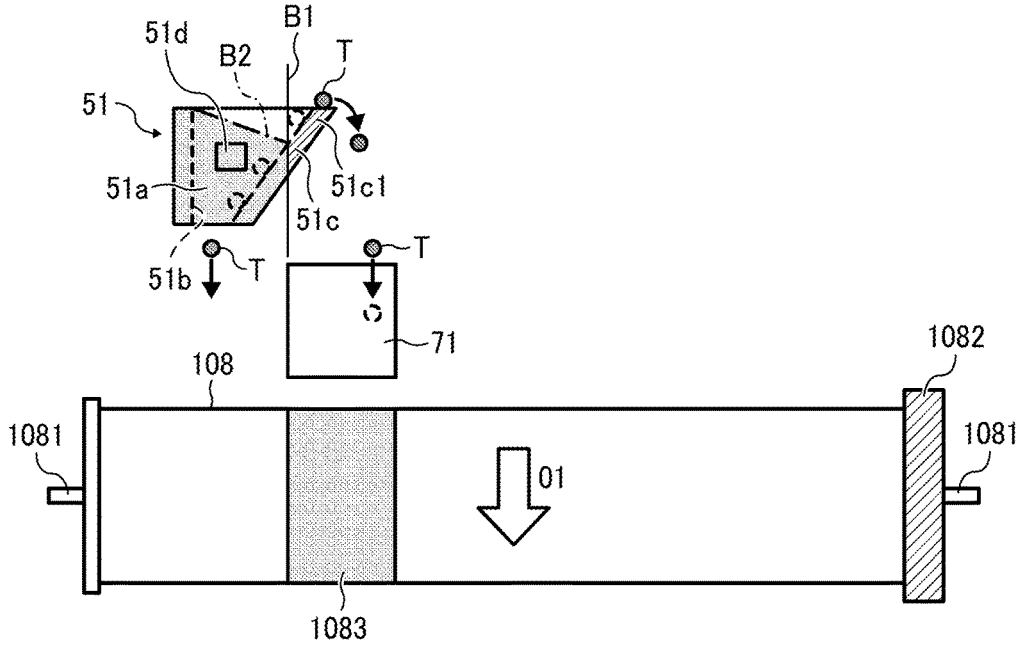
FIG. 7A is a schematic view illustrating relative positions of the spacer and the residual substance remover, according to an embodiment.

FIG. 7A illustrates the relative positions of the inclined portion 51*c* of the spacer 51, the residual substance remover 71, and the photoconductor 108 in the axial direction of the photoconductor 108. In FIG. 7A, an extension line B1 extends from the outer end of the residual substance remover 71 in the axial direction of the photoconductor 108. The residual substance remover 71 is disposed such that the extension line B1 crosses an inner portion of the inclined portion 51*c* of the spacer 51 in the axial direction as illustrated in FIG. 7A. With such relative positions, the residual substance remover 71 removes an adhering substance T on the photoconductor 108, arising from the upstream end (inner end) of the spacer 51 of the optical writing head 103, adjacent to the end of the toner layer range L3.

As described above, the surface of the photoconductor 108, which is rubbed by the residual substance remover 71, wears due to the friction with the residual substance remover 71. FIG. 7A illustrates the surface of the photoconductor 108 that is streaked in the rotation direction 01 by the abrasion and includes an abraded portion 1083 extending in the rotation direction 01.

When the entire inclined portion 51*c* falls in the abraded portion 1083, the spacer 51 is inclined with the linear portion 51*b* serving as a support point. Then, the distance between the optical writing head 103 and the photoconductor 108 decreases, degrading the exposure performance.

In view of the foregoing, in the present embodiment, the spacer 51 is disposed so that only the inner portion of the inclined portion 51*c* contacts the abraded portion 1083. In FIG. 7A, a line B2 connects the inner end portion (hatched with parallel liens in FIG. 7A) of the inclined portion 51*c* disposed in the abraded portion 1083 and the end of the linear portion 51*b*. The relative positions between the spacer 51 and the residual substance remover 71 thus defined inhibit the spacer 51 from inclining even when the inner portion of the inclined portion 51*c* overlaps the abraded portion 1083. Thus, fluctuations in the distance between the optical writing head 103 and the photoconductor 108 with elapse of time are suppressed, maintaining the exposure performance of the optical writing head 103.

In this case, as illustrated in FIG. 7A, the columnar portions 51*d* bearing the load of the optical writing head 103 is positioned downstream from the line B2, which connects the hatched inner portion of the inclined portion 51*c* and the end of the linear portion 51*b*. In other words, in a range enclosed by the linear portion 51*b*, the line B2, and the rest of the inclined portion 51*c* (outside the abraded portion 1083), the spacer 51 is not inclined and bears the force acting on the columnar portions 51*d*.

When the columnar portions 51*d* is disposed outside the range thus enclosed, the spacer 51 is inclined by the load applied to the columnar portions 51*d*, changing the height of the optical writing head 103 relative to the photoconductor 108. Accordingly, the exposure performance of the optical writing head 103 is degraded.

Figure 7B:
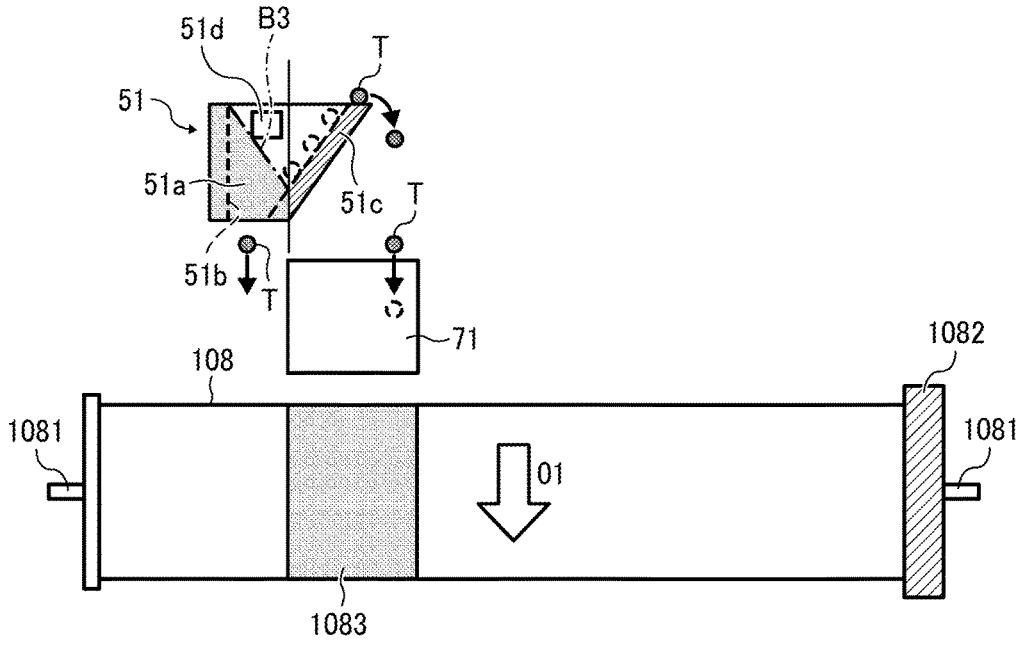
FIG. 7B is a schematic view illustrating relative positions of the spacer and a residual substance remover according to a comparative example.
Figure 8A:
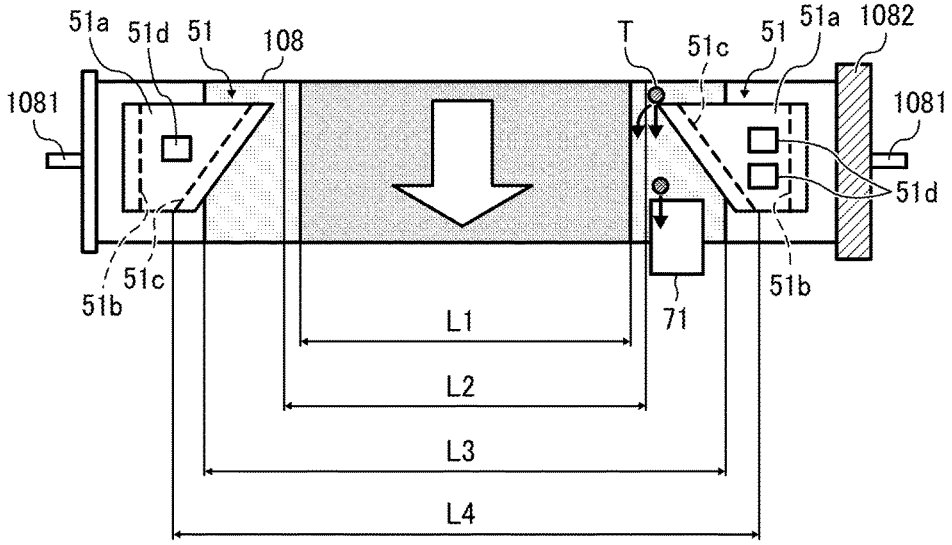
FIG. 8A illustrates an arrangement of the spacers and the residual substance removers relative to a photoconductor, according to an embodiment.

Additionally, as illustrated in FIG. 7B, when the entire inclined portion 51*c* falls inside the abraded portion 1083, the spacer 51 is inclined over time, regardless of the position of the columnar portions 51*d*. Consequently, the height of the optical writing head 103 relative to the photoconductor 108 changes, degrading the exposure performance of the optical writing head 103. In FIG. 7B, a line B3 connects the end of the linear portion 51*b* and the inner end portion (hatched with parallel liens in FIG. 7B) of the inclined portion 51*c* disposed in the abraded portion 1083 and Next, descriptions are given below of the relation between the placement illustrated in FIG. 7A and the width of largest sheet size (hereinafter "largest sheet width L2"), with reference to FIGS. 8A and 8B. In FIG. 8A, the residual substance remover 71 is disposed inside the cleaning blade width L4 and outside the largest sheet width L2 corresponding to the width of the largest sheet size that can be fed in the process unit 102.

With the residual substance remover 71 disposed as illustrated in FIG. 8A, even when the residual substances fall from the inner end of the inclined portion 51*c*, the residual substance remover 71 removes the residual substances. Accordingly, streaks on recording sheets are suppressed.

Figure 8B:
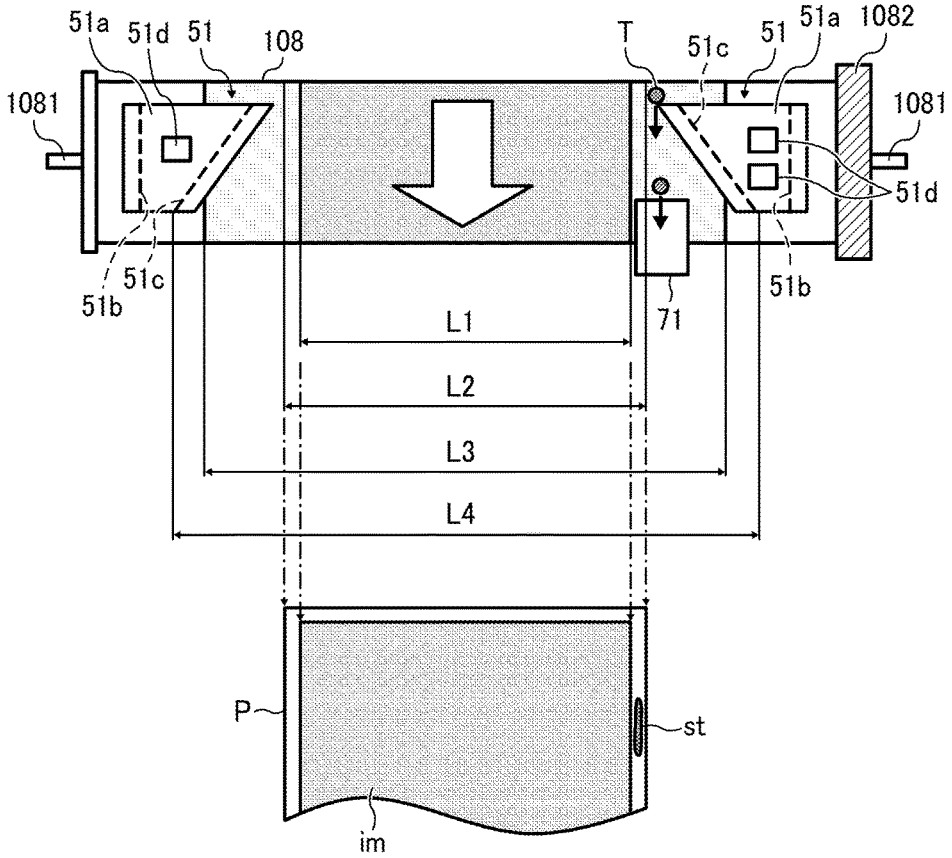
FIG. 8B illustrates another arrangement of the spacers and the residual substance removers relative to the photoconductor.

By contrast, in FIG. 8B, the residual substance remover 71 is disposed within the cleaning blade width L4 and overlapping the end of the largest sheet width L2. With the residual substance remover 71 disposed as illustrated in FIG. 8B, when streaks are produced on recording sheets due to the wear of the photoconductor 108 near end of the operational life of the process unit 102, users can perform a cleaning operation. Alternatively, the users recognize the end of the operational life of the process unit 102. That is, when the residual substances fall from the inner end of the inclined portion 51*c* and adhere to a margin of a recording sheet P as a streak st as illustrated in FIG. 8B, the users recognize that there are substances adhering to the photoconductor 108.

Since the streak st is produced in the margins of the recording sheet P, an image im according to image data is not disturbed. It is to be noted that, there are image forming apparatuses that determine the operational life of the process unit 102 based on data of a counter of the image forming apparatus 100 or data stored in a chip of the process unit 102 and alert the users to the end of the operational life. With the configuration illustrated in FIG. 8B, the image (or the streak st) on the output recording sheet serves as the alert about the end of the operational life, thus simplifying the alerting.

Attachment of the Residual Substance Remover

Figure 9A:
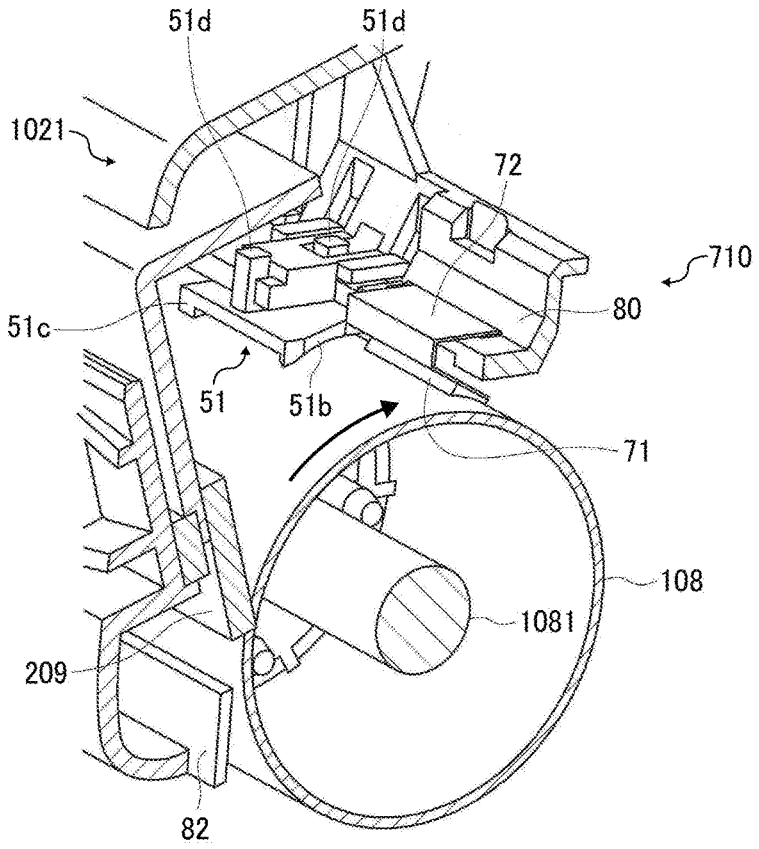
FIG. 9A is a perspective view illustrating attachment of the residual substance remover for the photoconductor, according to an embodiment.
Figure 9B:
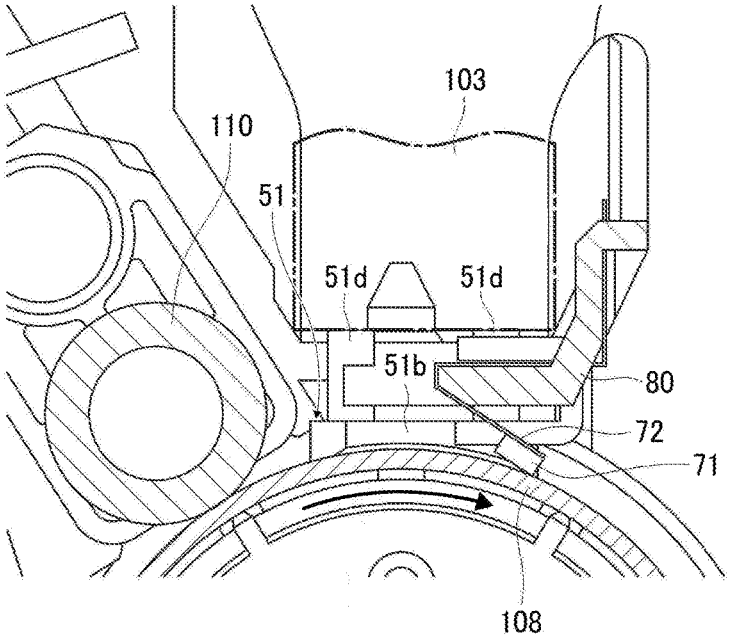
FIG. 9B is a side view illustrating attachment of the residual substance remover for the photoconductor, illustrated in FIG. 9A.

FIGS. 9A and 9B illustrate a structure to support the residual substance remover 71. FIG. 9A is a perspective view of an end portion of the photoconductor 108, and FIG. 9B is a cross-sectional view of the end portion of the photoconductor 108 illustrated in FIG. 9A. As described above, the residual substance remover 71 contains a material having the polishing effect to remove the substances adhering to the photoconductor 108.

The residual substance remover 71 is coupled via a support plate 72 (i.e., a support) to a holder 80 supporting the spacer 51. Supporting the spacer 51 and the residual substance remover 71 with an identical component (i.e., the holder 80) can enhance the positioning accuracy of the spacer 51 and the residual substance remover 71 relative to each other.

When the support plate 72 supporting the residual substance remover 71 is made of a flat spring material such as Steel Use Stainless (SUS) 301 according to Japan Industrial Standard (JIS), a spring such as the coil spring 721 illustrated in FIGS. 3A and 3B is not required, thus reducing the number of components.

For example, the residual substance remover 71 is attached to an end portion of the support plate 72 using double-sided adhesive tape or glue. Using deformation of the support plate 72, the residual substance remover 71 can be reliably biased toward the photoconductor 108 in a simple and inexpensive manner.

The residual substance remover 71 is disposed contacting the photoconductor 108 in the direction following (i.e., trailing) to the rotation direction 01 of the photoconductor 108. Then, the powdered substances scraped off by the residual substance remover 71 flow downstream in the rotation direction 01. Accordingly, adhesion of the substances arising from the end of the residual substance remover 71 is inhibited. The powdered substances flowing downstream on the surface of the photoconductor 108 are again scraped off by the cleaning blade 209 and transported together with waste toner to the waste toner container 124.

Thus, according to the above-described embodiment, the residual substance remover 71 can remove adhering substances in the axial end portions on the surface of the photoconductor 108, corresponding to the ends of the toner layer range L3 of the developing roller 111. Specifically, the adhering substances arise from the upstream end (the axial inner end) of the spacer 51 interposed between the optical writing head 103 and the photoconductor 108.

Variation of the Removing Device

Figure 10:
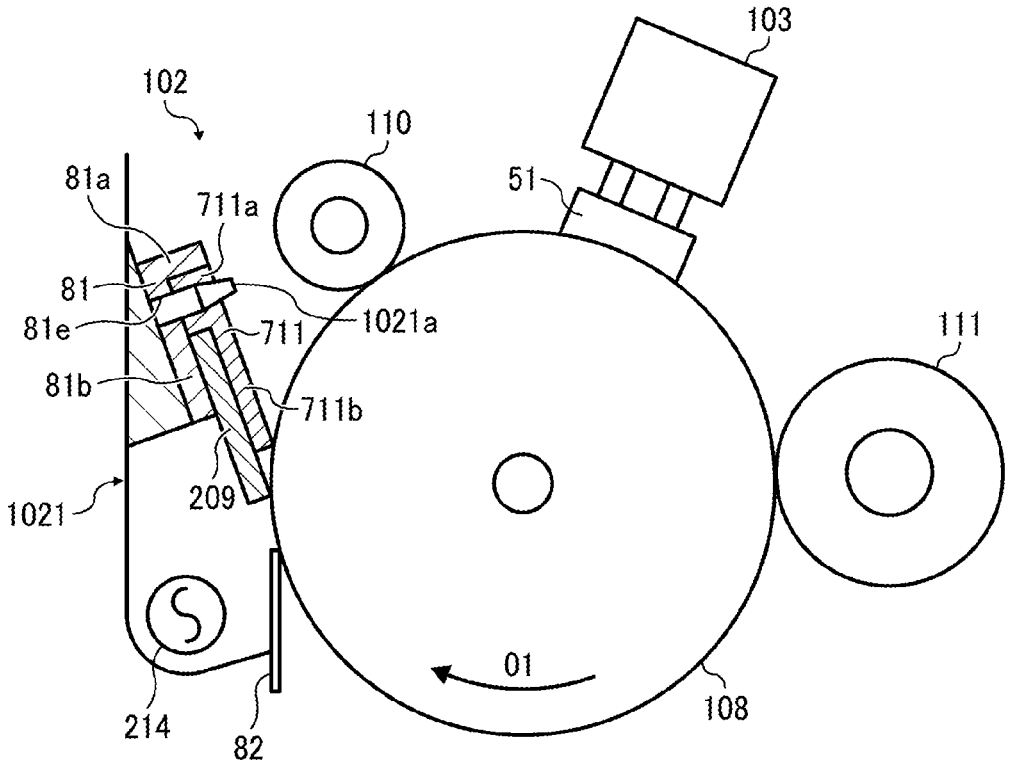
FIG. 10 is a schematic cross-sectional view illustrating attachment of the residual substance remover for the photoconductor, according to a variation.

FIG. 10 is a schematic view of a variation of the removing device 710 used in the process unit 102 illustrated in FIG. 2.

The variation illustrated in FIG. 10 employs residual substance removers 711 disposed upstream from the charging roller 110 and downstream from the cleaning blade 209 in the rotation direction 01 of the photoconductor 108, differently from the positions (downstream from the charging roller 110) illustrated in FIGS. 3A and 3B. The residual substance remover 711 is supported by a cleaning blade holder 81 to support the cleaning blade 209.

In the embodiment described above, as illustrated in FIGS. 9A and 9B, the residual substance remover 71 is coupled via the support plate 72 to the holder 80 supporting the spacer 51 and is supported by the housing of the optical writing head 103. When the housing of the optical writing head 103 is made of resin, the rigidity of the holder 80 is lower compared with a case where the residual substance remover 71 is supported by a metal holder. By contrast, the cleaning blade holder 81 holding the cleaning blade 209 is made of metal. When the residual substance remover 711 is attached to the cleaning blade holder 81, the rigidity to support the residual substance remover 711 is enhanced, and the residual substance remover 711 is crimped to the photoconductor 108 with a stable force.

Figure 11A:
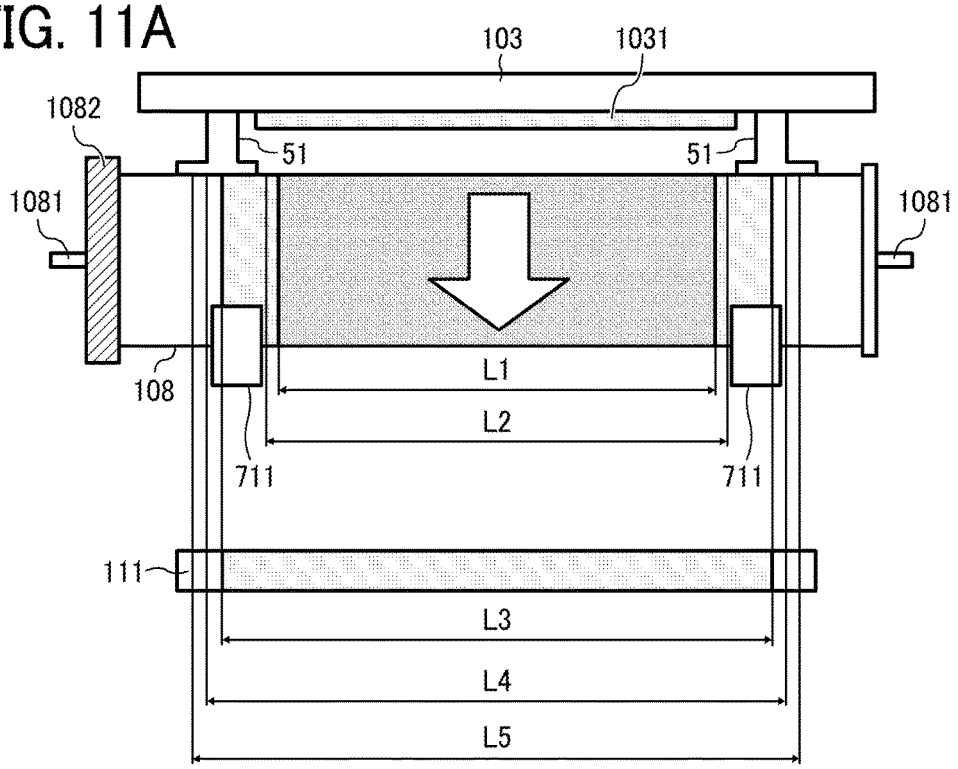
FIG. 11A is a diagram illustrating an arrangement of the spacers and the residual substance removers illustrated in FIG. 10, relative to the photoconductor.

The shape and the position of the residual substance removers 711 in the axial direction can be similar to those illustrated in FIG. 4. Alternatively, the residual substance removers 711 can be shifted from the largest sheet width L2 to the outer side in the axial direction as illustrated in FIG. 11A. In the configuration illustrated in FIG. 11B, the residual substance removers 711 are disposed inside a charging roller width L5. With this placement, while inhibiting the wear of the photoconductor 108 inside the image area, the residual substance removers 711 can remove the substances adhering to the axial end areas of the photoconductor 108 corresponding to the ends of the toner layer range L3 and additionally remove adhering substances growing from minute flaws on the photoconductor 108.

Additionally, when the residual substance remover 711 are positioned upstream from the charging roller 110, the residual substance removers 711 are inhibited from affecting the electrostatic latent image, that is, the image area on the surface of the photoconductor 108. Accordingly, the layout ranges of the residual substance removers 711 in the axial direction of the photoconductor 108 increase, compared with the configuration illustrated in FIG. 4. Then, as illustrated in FIG. 11B, the inner end of the residual substance remover 711 can be positioned inside the largest sheet width L2 and inside the maximum exposure range L1 in the axial direction.

As illustrated in FIG. 11A, the residual substance removers 711 are usable in the image forming unit (the process unit 102) incorporating the LED optical writing head 103 similar to the above-described embodiment. The residual substance removers 711 are also usable in image forming units employing writing devices of other types, such as an optical scanning device that scans the surface of the photoconductor 108 in the axial direction with laser light, as illustrated in FIG. 11C.

The image forming unit employing the optical scanning device does not include the spacers 51, and streaks of toner and the like do not arise from the ends of the spacers 51. However, it is possible that streaks of toner and the like occur at the end of the largest sheet width L2, and the residual substance removers 711 are used in such a configuration. The shape and the position of the residual substance removers 711 can be similar to those in the FIG. 11A.

Figure 11B:
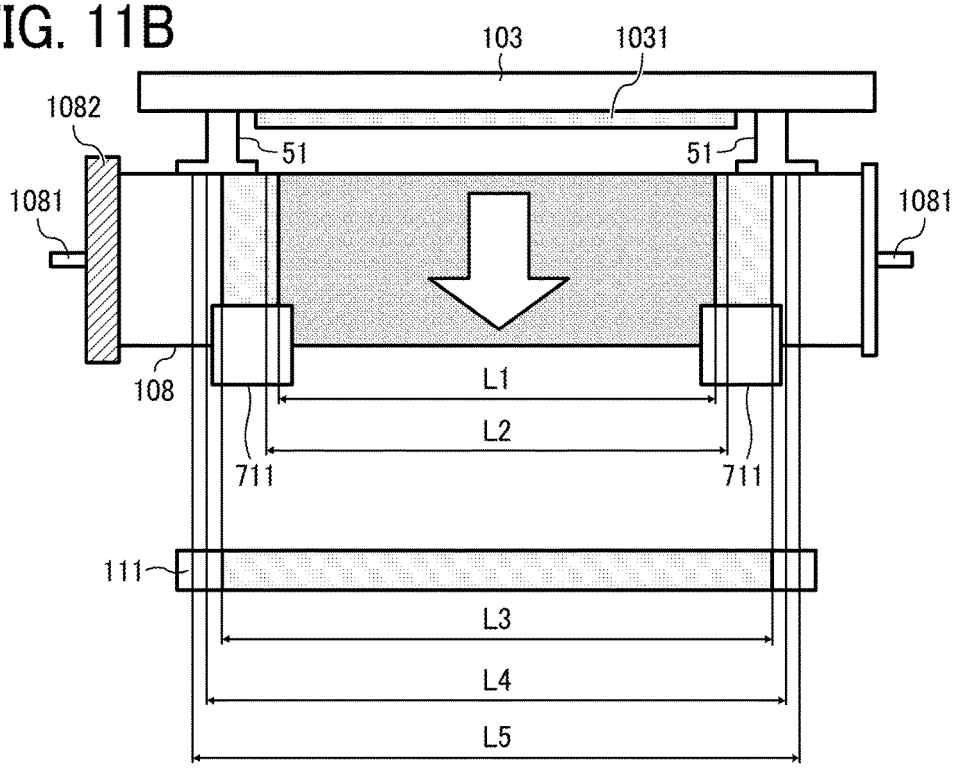
FIG. 11B is a diagram illustrating an arrangement of the spacers and the residual substance removers illustrated in FIG. 10, according to a variation.
Figure 11C:
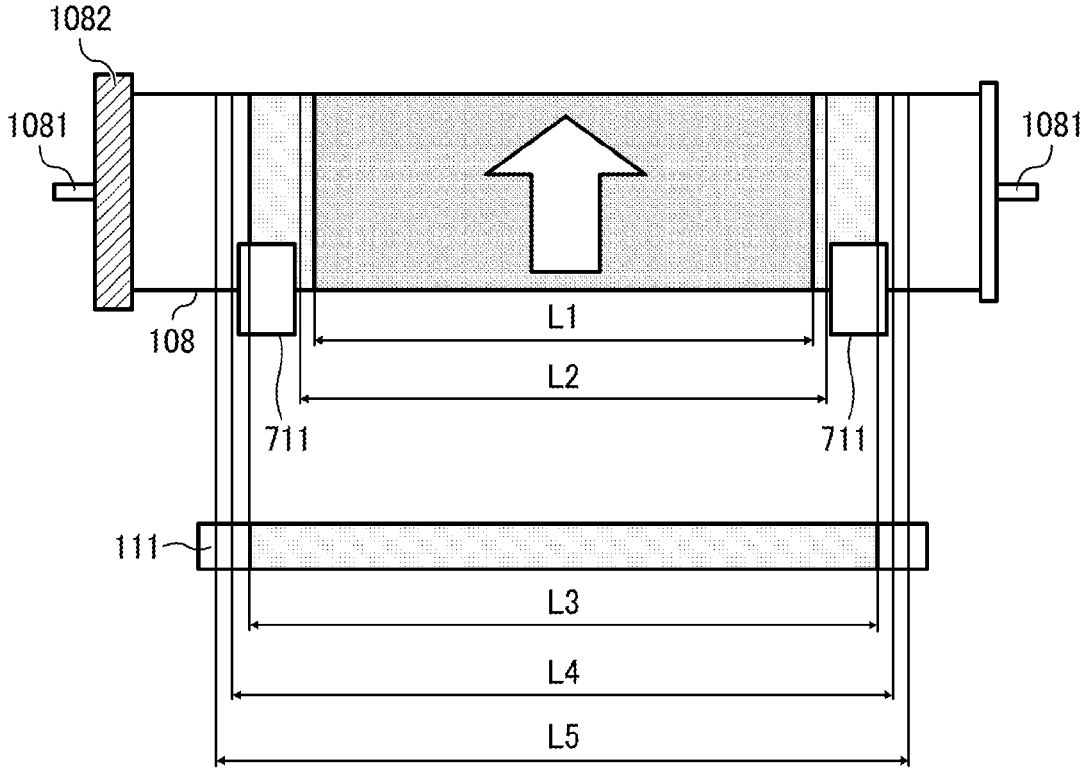
FIG. 11C is a diagram illustrating an arrangement of the residual substance removers in a configuration using an optical scanning device, according to another embodiment.
Figure 12A:
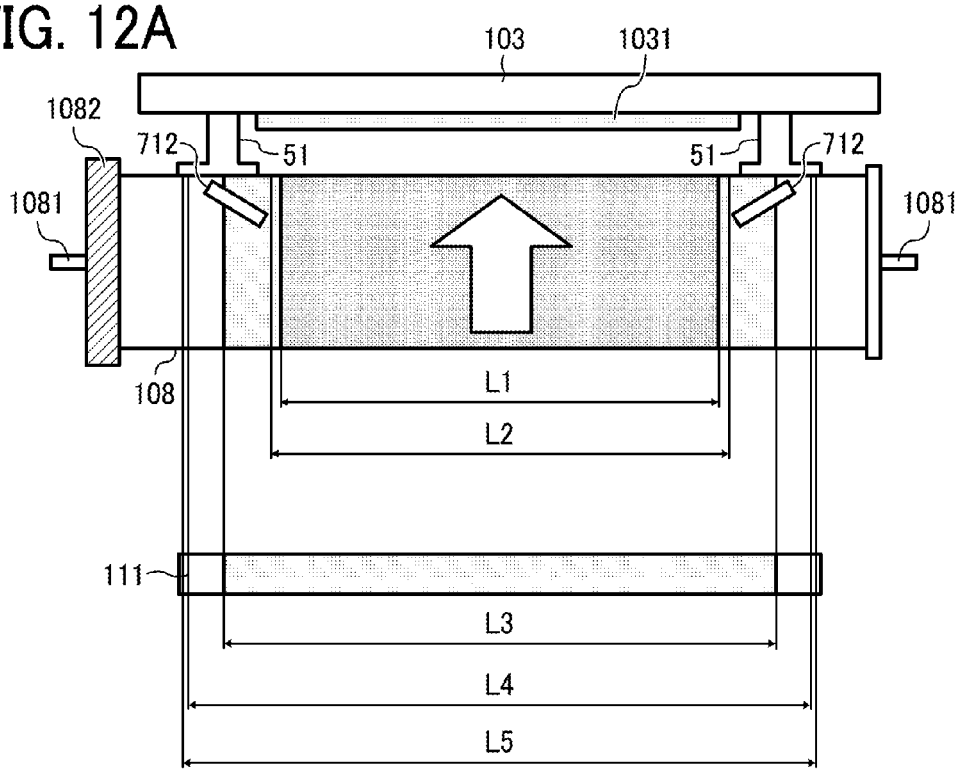
FIG. 12A a diagram illustrating an arrangement of residual substance removers according to another embodiment, different in shape and position from the configuration illustrated in FIG. 11A.
Figure 12B:
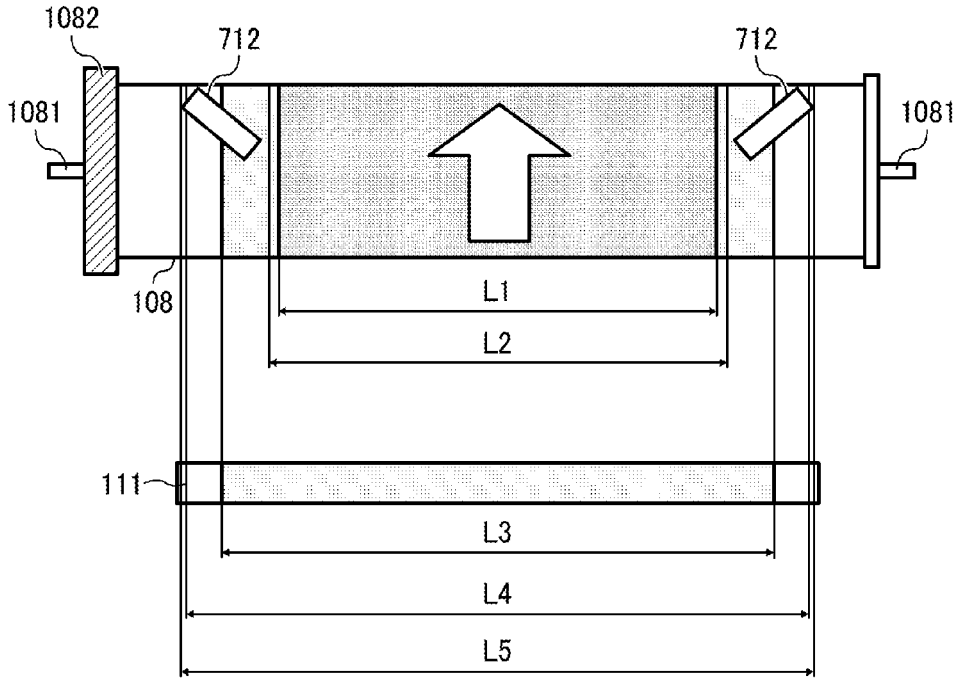
FIG. 12B a diagram illustrating an arrangement of residual substance removers according to another embodiment, different in shape and position from the configuration illustrated in FIG. 11C.

Although the residual substance removers 711 illustrated in FIGS. 11A through 11C are shaped like simple rectangles, the shape is not limited thereto. For example, as illustrated in FIGS. 12A and 12B, residual substance removers 712 shaped like strips are disposed oblique to the axial direction of the photoconductor 108. The residual substance removers 712 shape and disposed as illustrated in FIGS. 12A and 12B can guide the substances such as residual toner on the photoconductor 108 to the outer sides in the axial direction of the photoconductor 108, thereby inhibiting streaks of such substances from being transferred onto the recording sheet. Additionally, when the residual substance removers 712 are oblique to the axial direction, the area of contact with the photoconductor 108 is larger, thus enhancing the removing capability, compared with residual substance removers similar to the residual substance removers 712 in the length in the axial direction and are disposed parallel to the axial direction.

Figure 13:
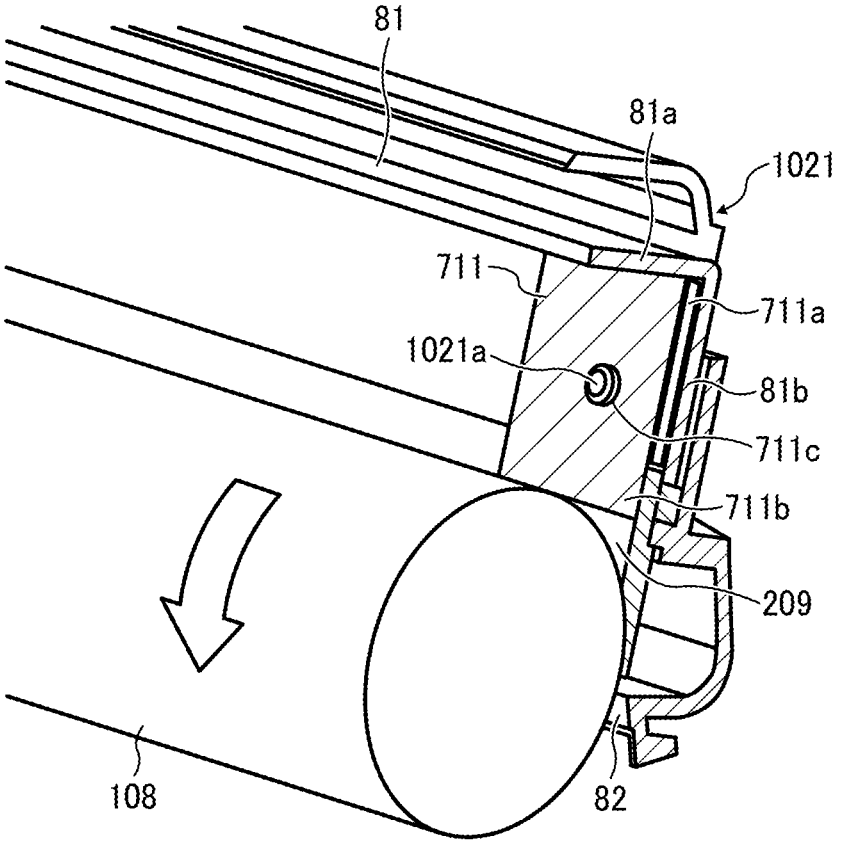
FIG. 13 is a schematic perspective view illustrating attachment of the residual substance removers illustrated in FIG. 10.

FIG. 13 is a perspective view illustrating a structure to attach the residual substance remover 711 illustrated in FIGS. 11A through 11C to the cleaning blade holder 81 of the cleaning blade 209. The cleaning blade 209 is disposed upstream from the charging roller 110 illustrated in FIG. 2 and extends in the axial direction of the photoconductor 108 as indicated by the cleaning blade width L4 illustrated in FIG. 4. The cleaning blade holder 81 has a width equal or similar to the cleaning blade width L4 and extends in the axial direction of the photoconductor 108. The cleaning blade holder 81 is secured to the exterior case 1021 of the process unit 102 as illustrated in FIG. 10.

Specifically, the inner face of the exterior case 1021 has a pair of projections 1021*a*. The projections 1021*a* are positioned at the respective ends in the axial direction and molded as a single piece, or jointed together, with the exterior case 1021. Each projection 1021*a* has a tapered end that is columnar. As the projections 1021*a* are inserted into holes 81*e* at both ends of the cleaning blade holder 81, the cleaning blade holder 81 is positioned relative to the exterior case 1021.

The cleaning blade holder 81 is made of metal and, to increase the rigidity, has an L-shaped cross section. The L-shaped cross section illustrated in FIG. 10 includes a short bar 81*a* and a long bar 81*b* jointed to each other. The long bar 81*b* has the holes 81*e* at both ends in the axial direction of the photoconductor 108. The ends of the projections 1021*a* project from the respective holes 81*e*.

As illustrated in FIG. 13, the residual substance remover 711 is shaped like a rectangular plate and includes a thick portion 711*a* and a thin portion 711*b* below the thick portion 711*a* in FIG. 13 (positioned closer to the photoconductor 108 than the thick portion 711*a*). The thick portion 711*a* has a hole 711*c* penetrated by the projection 1021*a*. As the projection 1021*a* is inserted in the hole 711*c*, the upper end (opposite the end contacting the photoconductor 108) of the residual substance remover 711 contacts the short bar 81*a* of the cleaning blade holder 81, and the position of the residual substance remover 711 is determined.

Thus, the position of the residual substance remover 711 is defined without adding a separate positioning component or processing an existing component for positioning. That is, the residual substance remover 711 can be positioned in an inexpensive manner. Additionally, when the residual substance remover 711 is attached to the metal cleaning blade holder 81 supporting the cleaning blade 209, the residual substance remover 711 reliably contacts or abuts against the photoconductor 108.

The thin portion 711*b* of the residual substance remover 711 on the lower side of the thick portion 711*a* in FIG. 13 is about the haft in thickness of the thick portion 711*a*. The cleaning blade 209 is interposed between the thin portion 711*b* and the cleaning blade holder 81, and a base end (the upper end in FIG. 13) of the cleaning blade 209 abuts a step between the thick portion 711*a* and the thin portion 711*b*. The cleaning blade holder 81, the cleaning blade 209, and the residual substance remover 711 are bonded to each other via double-sided adhesive tape or glue.

Figure 14A:
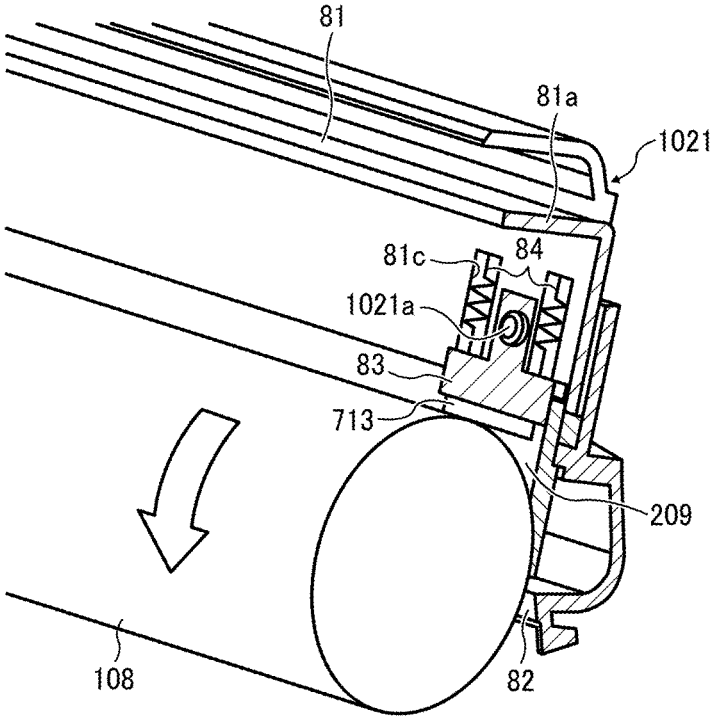
FIG. 14A is a schematic perspective view of a residual substance remover according to another embodiment.
Figure 14B:
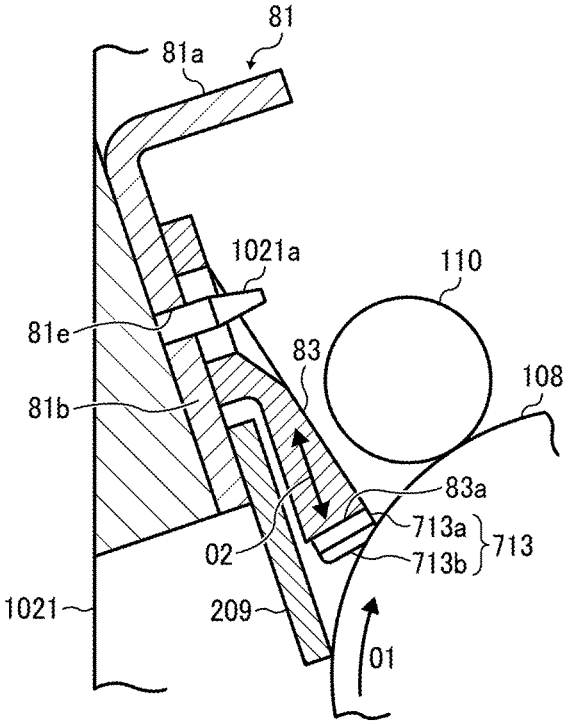
FIG. 14B is a cross-sectional view of the residual substance remover illustrated in FIG. 14A.

FIGS. 14A and 14B illustrate a residual substance remover 713 that is movable in a direction indicated by arrow 02 (vertical in FIGS. 14A and 14B) to approach and draw away from the photoconductor 108, as a variation. The residual substance remover 713 is disposed at each end in the axial direction of the photoconductor 108. Specifically, a pair of springs 84 biases the residual substance remover 713 to the photoconductor 108, downward in FIGS. 14A and 14B. As illustrated in FIG. 14B, the residual substance remover 713 includes an upper layer, namely, a urethane rubber layer 713*a*, and a lower layer, namely, a polishing layer 713*b*. A surface of the urethane rubber layer 713*a* (an upper surface of the residual substance remover 713) is bonded, via double-sided adhesive tape or glue, to a bottom face 83*a* of a holder 83 made of resin. The springs 84 disposed side by side laterally in FIG. 14A bias the holder 83 to the photoconductor 108. At both ends in the axial direction (i.e., lateral ends in FIG. 14A), the end of the cleaning blade 209 is interposed between the holder 83 and the cleaning blade holder 81.

For attachment of the springs 84, two parallel rectangular slots 81*c* extend vertically in FIG. 14A, at each lateral end of the cleaning blade holder 81 in FIG. 14A. The springs 84 are contained in the rectangular slots 81*c*, respectively. In FIG. 14A, while the upper end of each spring 84 is held by a projection at an inner rim of the rectangular slot 81*c*, the lower end of the spring 84 is held by one of two projections 83*d* (illustrated in FIG. 15A) of the holder 83. The two projections 83*d* are disposed side by side in the lateral direction in FIGS. 14A and 15A.

Figure 15A:
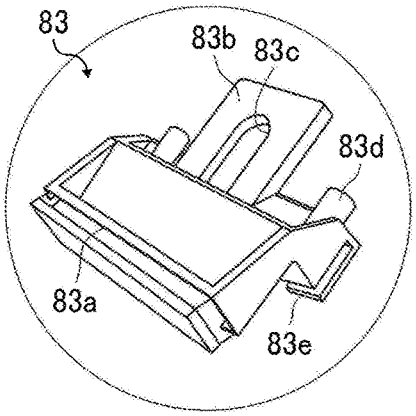
FIG. 15A is a perspective view of a holder of the residual substance remover illustrated in FIGS. 14A and 14B.
Figure 15B:
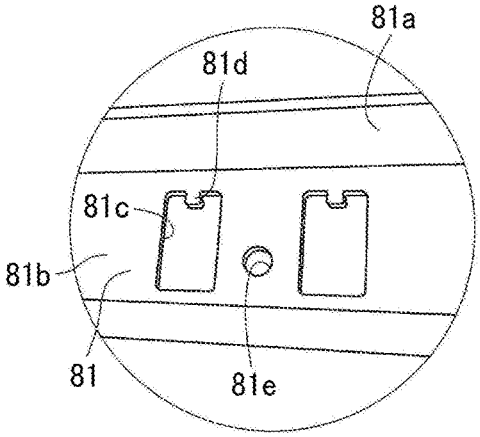
FIG. 15B is a cross-sectional view of a cleaning blade holder to which the residual substance remover is supported by the holder illustrated in FIG. 15A.
Figure 15C:
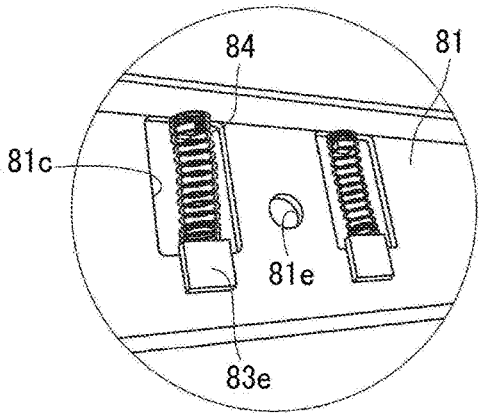
FIG. 15C is a perspective view of the cleaning blade holder illustrated in FIG. 15B, to which springs are attached.
Figure 15D:
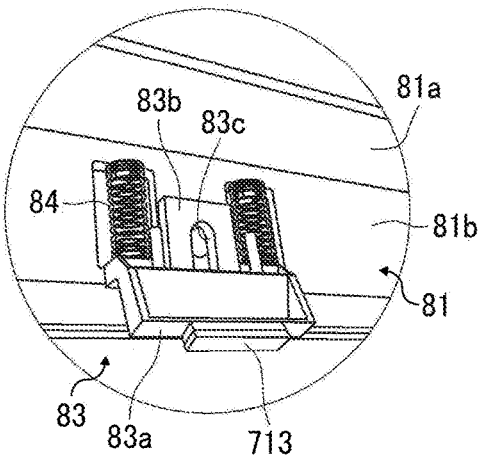
FIG. 15D is a perspective view of the cleaning blade holder to which the holder of the residual substance remover is attached via the springs illustrated in FIG. 15C.

An upper portion 83*b* (illustrated in FIGS. 15A and 15D) of the holder 83 is shaped like a rectangular plate and attached to the cleaning blade holder 81 to move in the direction indicated by arrow 02 in FIG. 14B to approach and draw away from the photoconductor 108. That is, a slot 83*c* extending vertically in FIGS. 15A and 15D is disposed at a center of the upper portion 83*b*. The projection 1021*a*, projecting from the hole 81*e* of the cleaning blade holder 81, is inserted in the slot 83*c*. The holder 83 includes an L-shaped engaging portion 83*e* at each lateral end thereof in FIG. 15A, and the engaging portion 83*e* engages the lower rim of the rectangular slots 81*c* in FIG. 15C.

The polishing layer 713*b* contains inorganic particles, such as cerium oxide, having the polishing effect. As illustrated in FIG. 14B, the polishing layer 713*b* contacts or abuts against the photoconductor 108 in the direction trailing to the rotation direction 01 (clockwise in FIG. 14B) of the photoconductor 108. Then, the powdered substances scraped off by the polishing layer 713*b* of the residual substance remover 713 flow downstream in the rotation direction 01. Accordingly, streaky adhesion of the substances is inhibited from arising from the end of the residual substance remover 713. The powdered substances flowing downstream on the surface of the photoconductor 108 are again scraped off by the cleaning blade 209 and transported together with waste toner to the waste toner container 124.

Use of a Flat Spring to Support the Residual Substance Remover

Next, referring to FIGS. 16 through 21D, descriptions are given below of a structure using a flat spring 720 to attach the residual substance remover 71 to the cleaning blade holder 81, as a variation. In the variation illustrated in FIG. 16, the residual substance remover 71 is attached via the flat spring 720 to the cleaning blade holder 81. A material having a spring capability, such as SUS301, is used for the flat spring 720. Using deformation of the flat spring 720, the residual substance remover 71 can be reliably biased to the photoconductor 108.

The residual substance remover 71 is disposed downstream from the cleaning blade 209 and upstream from the charging roller 110 in the rotation direction 01 of the photoconductor 108. The residual substance remover 71 contacts or abuts against the photoconductor 108 in the direction trailing to the rotation direction 01 thereof (clockwise in FIG. 16), thereby inhibiting streaky adhesion of the substances arising from the end of the residual substance remover 71. The powdered substances flowing downstream on the surface of the photoconductor 108 are again scraped off by the cleaning blade 209 and transported together with waste toner to the waste toner container 124.

Figure 16:
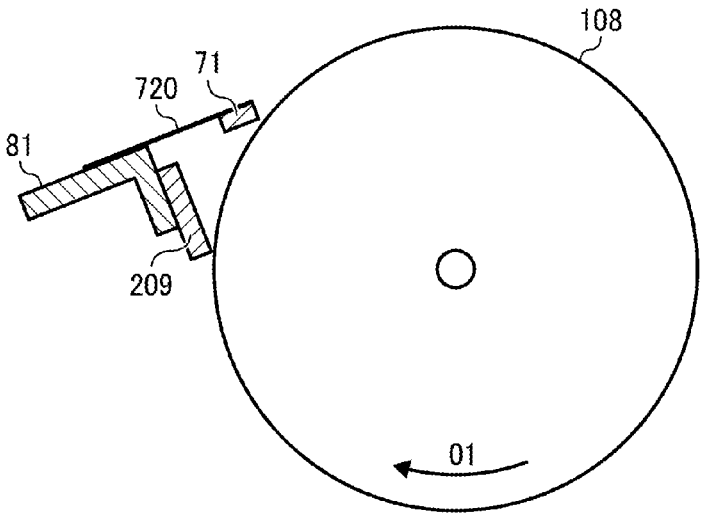
FIG. 16 is a schematic cross-sectional view of a flat spring, which supports the residual substance remover illustrated in FIGS. 3A and 3B, and adjacent components.

For example, the flat spring 720 is shaped like a flat plate as illustrated in FIG. 16. Alternatively, the flat spring 720 has a bent shape with at least one bent position. In a configuration in which the flat spring 720 extends toward the photoconductor 108 from a direction identical or similar to the direction of the cleaning blade 209, the bent shape is used to attain the contact in the trailing direction as illustrated in FIG. 17.

Bending the flat spring 720 can increase the elasticity of a bent end portion 72*c* (illustrated in FIG. 17, on the opposite end from the base end attached to the cleaning blade holder 81) and accordingly enhance the capability of the residual substance remover 71 to remove the streaky adhesion of substances on the photoconductor 108. To attach the flat spring 720 to the cleaning blade holder 81, the number of bending can be increased to avoid a rubber end portion of the cleaning blade 209 on a base side opposite the end contacting the photoconductor 108.

Figure 17:
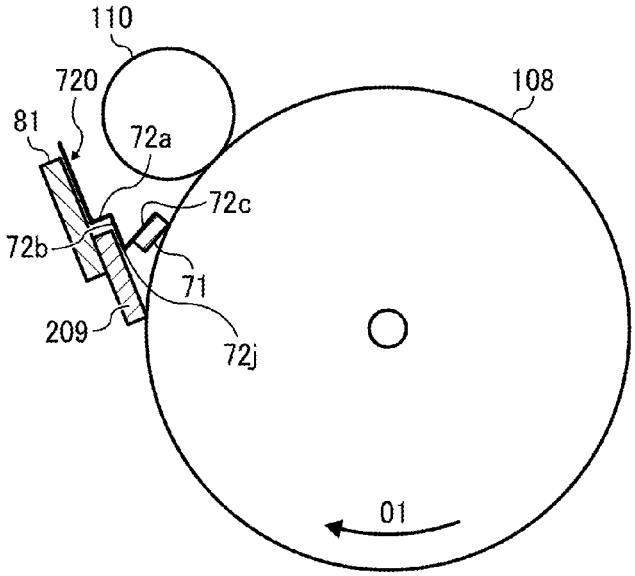
FIG. 17 is a schematic cross-sectional view of a flat spring having bent positions to support the residual substance remover, together with adjacent components.

That is, in the configuration illustrated in FIG. 17, the flat spring 720 is bent at three positions from the base end, which is attached to the cleaning blade holder 81, to the bent end portion 72*c*. At a first bent position of the flat spring 720, a raised portion 72*a* is raised from a mounting face of the cleaning blade holder 81, to which the base end of the flat spring 720 is attached. The raised portion 72*a* overstrides a thickness of the rubber end portion of the cleaning blade 209. At a second bent position, a blade covering portion 72*b* is crated to cover the end portion of the cleaning blade 209 on the base side. Third bending is made at an acute bent position 72*j*.

The bent end portion 72*c* extends from the acute bent position 72*j* to the end of the flat spring 720. The residual substance remover 71 is secured via glue or double-sided adhesive tape to the bent end portion 72*c*. Thus, the bent end portion 72*c* is on a supporting end side supporting the residual substance remover 71. When the bent end portion 72*c* is pivotable around the acute bent position 72*j*, the residual substance remover 71 can has an increased capability to remove the adhering substances.

Figure 18:
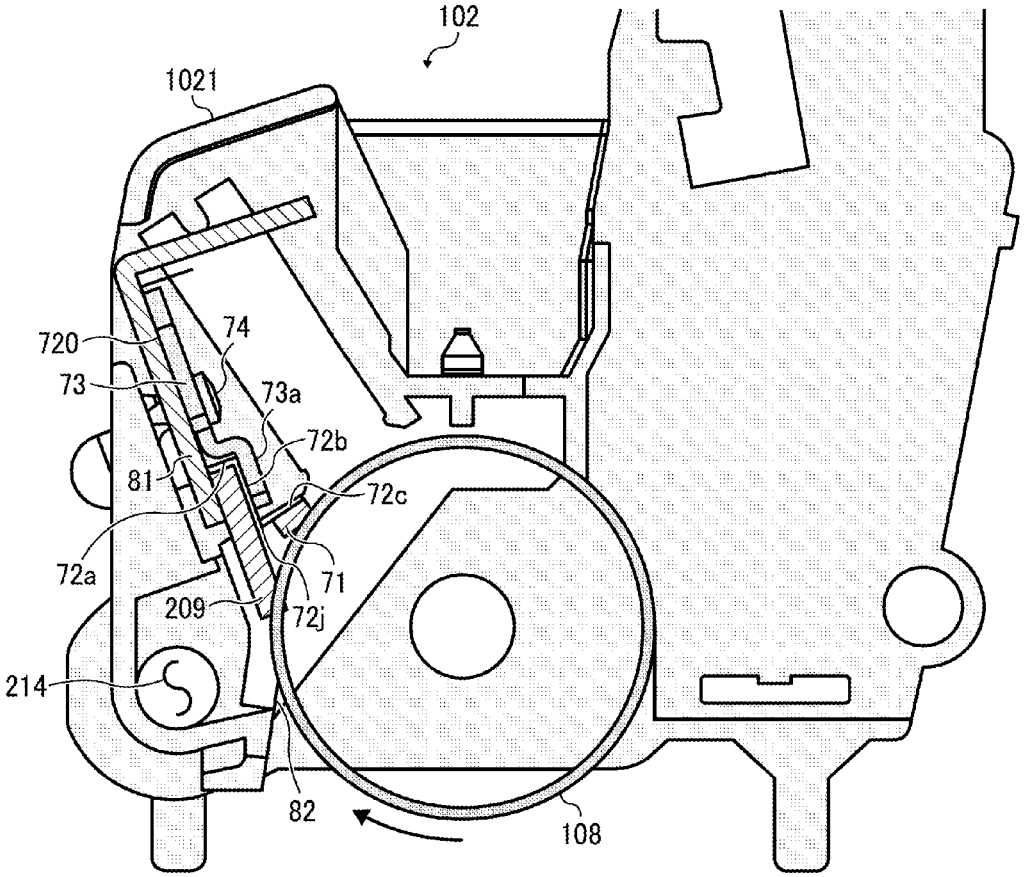
FIG. 18 is a schematic cross-sectional view illustrating attachment of the flat spring illustrated in FIG. 17, to the cleaning blade holder.

FIG. 18 illustrates the structure to attach the flat spring 720 to the cleaning blade holder 81 inside the process unit 102.

The flat spring 720 is bent as illustrated in FIG. 17, and the bent end portion 72*c* (on the side of the supporting end) of the flat spring 720 opposes the face of the photoconductor 108. The bent end portion 72*c* is positioned closer to the supporting end than the acute bent position 72*j* (the third bent position). The bent end portion 72*c* is pivotable around the acute bent position 72*j* in the radial direction of the photoconductor 108.

The base end of the flat spring 720 is interposed between the cleaning blade holder 81 and a cover 73 and, together with the cover 73, screwed to the cleaning blade holder 81 with screws 74. As long as a predetermined strength and a predetermined durability are attained, the material of the cover 73 is not limited but can be freely selected from, for example, metal, ceramic, and resin materials. When the cover 73 is made of metal, the space of the cover 73 is reduced.

When the cover 73 is not used, due to the load of sliding between the residual substance remover 71 and the photoconductor 108, the residual substance remover 71 makes small back-and-forth movement in the rotation direction 01 of the photoconductor 108 repeatedly. That is, the photoconductor 108 vibrates. As a result, noise of machine vibration and chattering can occur. The cover 73 can suppress the vibration of the flat spring 720, thereby reducing the occurrence of the noise.

Biasing the residual substance remover 71 with the flat spring 720 made of a spring material such as SUS is advantageous in restricting the force of the cover 73 to secure the flat spring 720 to such a degree that the flat spring 720 does not lose the bias force. Specifically, in the example illustrated in FIG. 18, the end portion of the flat spring 720 starting from the acute bent position 72*j* is kept fee. In other words, the flat spring 720 is cantilevered.

Figure 19A:
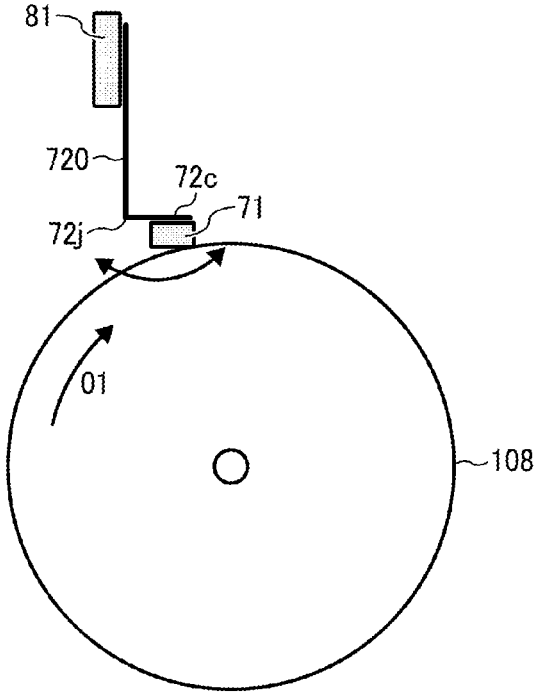
FIGS. 19A and 19B are schematic views for understanding of a procedure of attachment of the flat spring illustrated in FIG. 18.
Figure 19B:
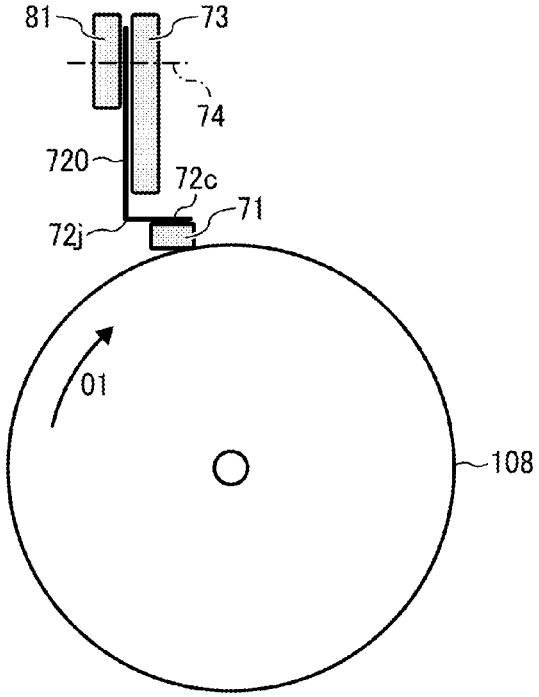

FIGS. 19A and 19B are schematic views for understanding of an attachment procedure of the flat spring 720. Initially, as illustrated in FIG. 19A, the flat spring 720 is positioned on the cleaning blade holder 81. Then, as illustrated in FIG. 19B, the cover 73 is placed on the base end portion of the flat spring 720. Then, the flat spring 720 and the cover 73 are screwed to the cleaning blade holder 81 with the screws 74.

Figure 20:
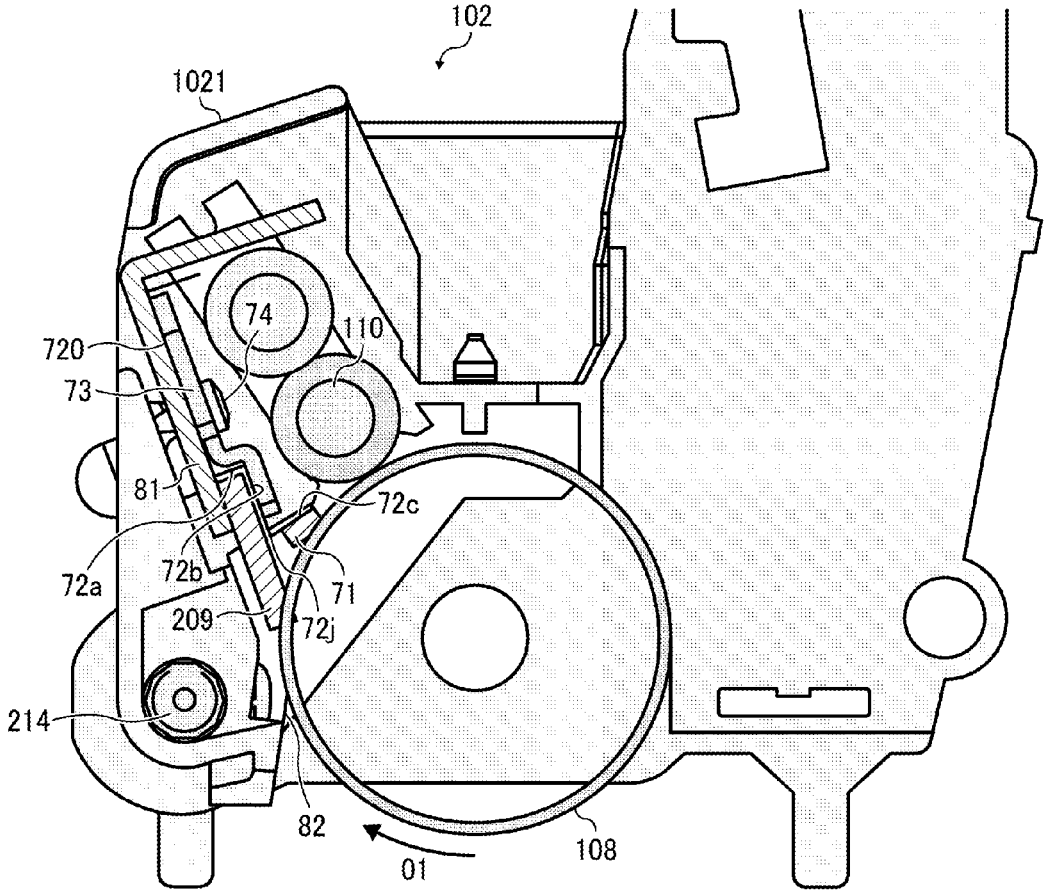
FIG. 20 is a schematic cross-sectional view of the flat spring attached inside the process unit.

FIG. 20 illustrates the flat spring 720 attached inside the process unit 102. FIGS. 21A through 21D illustrate the structure to attach the flat spring 720 to the process unit 102. It is to be noted that electrical discharge of the flat spring 720 is to be considered in a case where the charging roller 110 is disposed adjacent to and downstream from the cleaning blade 209 in the rotation direction 01 of the photoconductor 108, as illustrated in FIG. 20.

That is, a distance of 1 mm or greater is kept between the cover 73 and the charging roller 110 to prevent the occurrence of electrical discharge between the flat spring 720, which supports the residual substance remover 71, and the cover 73. When the cover 73 is made of an insulative resin, the possibility of electrical discharge is low, and the distance between the cover 73 and the charging roller 110 can be smaller than 1 mm.

Figure 21A:
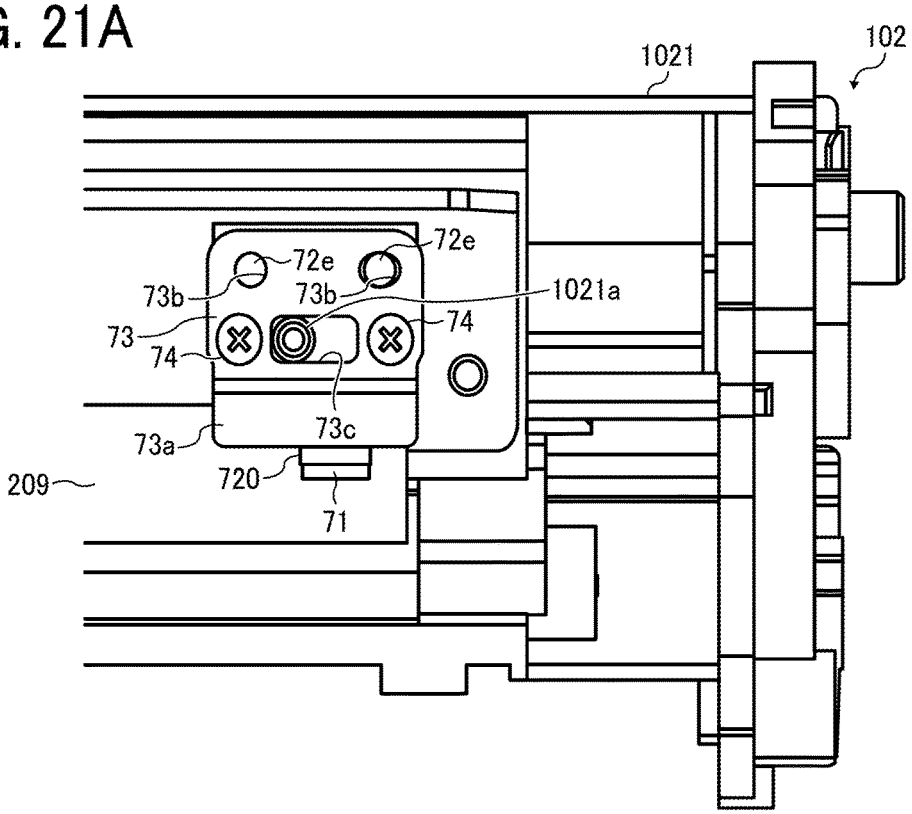
FIGS. 21A, 21B, and 21C are partial views of the process unit, for understanding of attachment of the flat spring illustrated in FIG. 20.
Figure 21B:
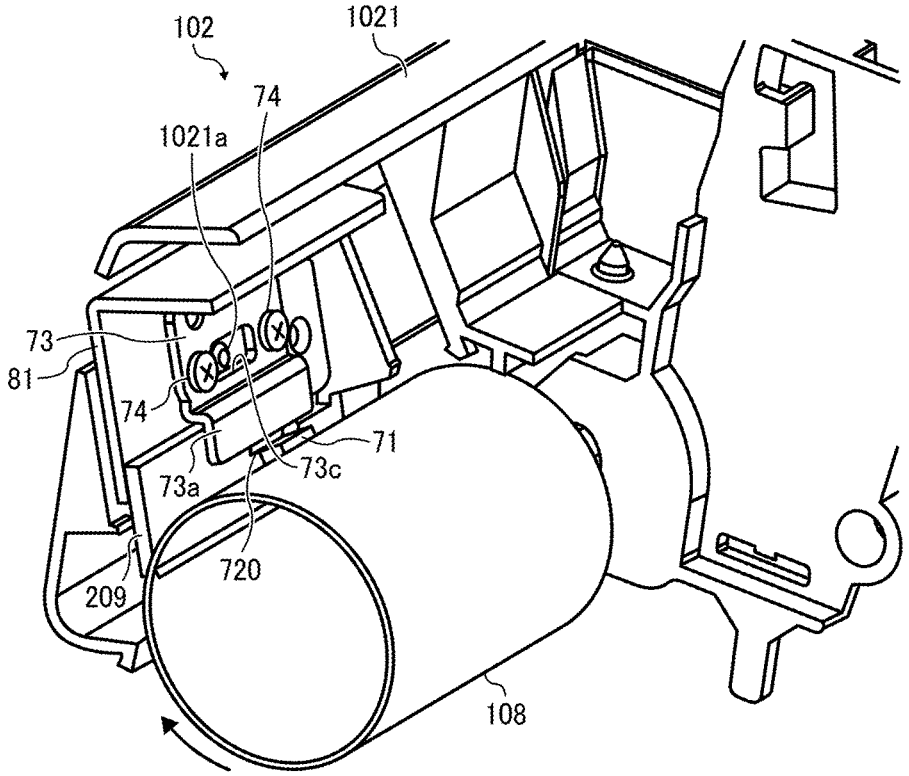
Figure 21C:
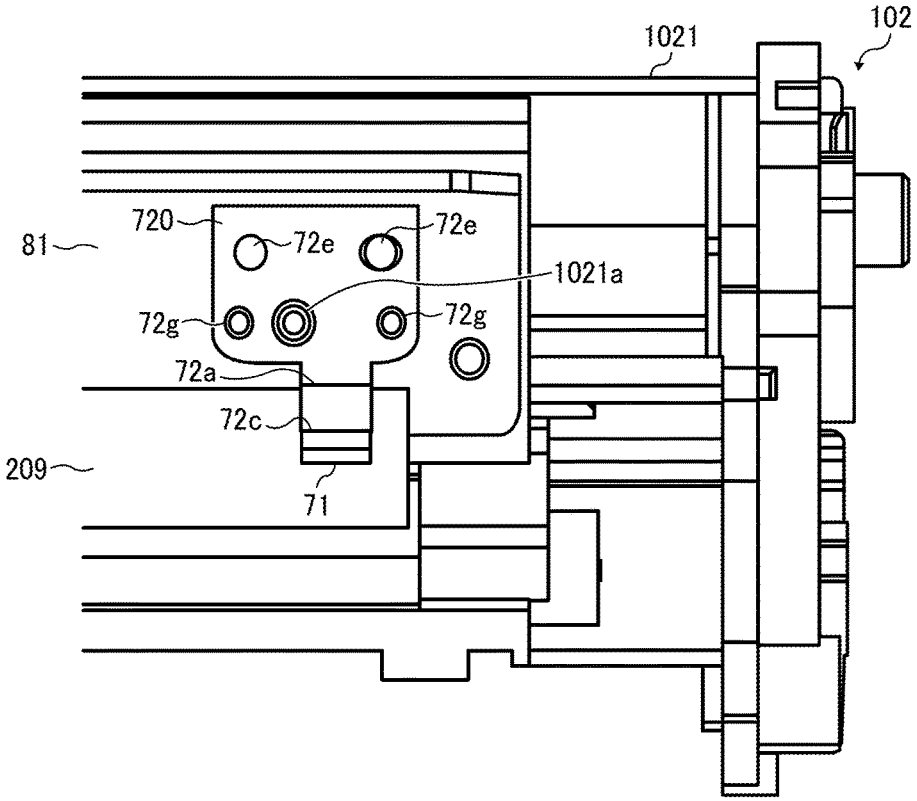
Figure 21D:
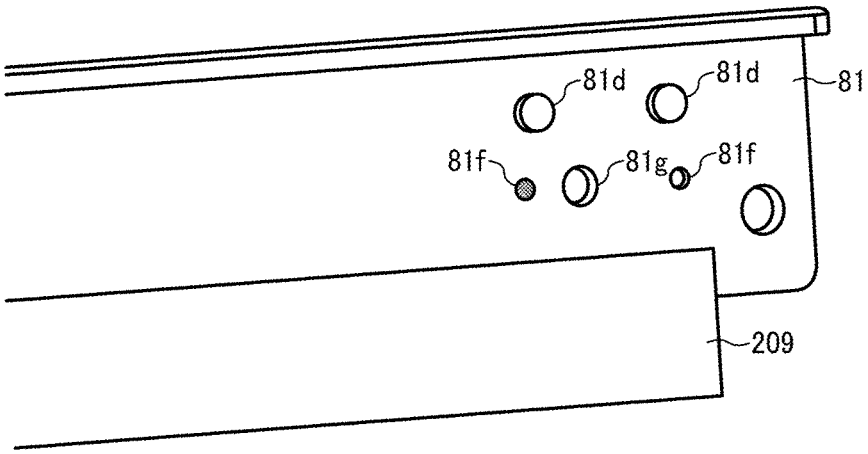
FIG. 21D is an enlarged view illustrating positioning holes of the cleaning blade holder for attachment of the flat spring illustrated in FIG. 20.

As illustrated in FIG. 21D, the cleaning blade holder 81 has two extruded bosses 81*d* (projecting holes), a through hole 81*g*, and two screw holes 81*f*. The bosses 81*d* project to the front side of the paper on which FIG. 21D is illustrated.

As illustrated in FIG. 21C, the face of the flat spring 720 attached to the cleaning blade holder 81 (i.e., attached face) face the bosses 81*d* and has two extruded bosses 72*e* (projecting holes), a through hole 72*f*, and two holes 72*g*. The bosses 72*e* project to the front side of the paper on which FIG. 21C is illustrated.

When the bosses 81*d* of the cleaning blade holder 81 are aligned with and fitted in the respective bosses 72*e* of the flat spring 720, the position of the flat spring 720 is determined relative to the cleaning blade holder 81 easily. Although the flat spring 720 is positioned using bosses at two positions in FIGS. 21A through 21D, other positioning structures are possible. For example, when the projection 1021*a* (boss) on the exterior case 1021 is used, the number of the extruded bosses is reduced to one (for rotation stopper). The projection 1021*a* is used to determine the position of the cleaning blade holder 81 relative to the exterior case 1021 of the process unit 102 using the through hole 81*g*.

After the position of the flat spring 720 is thus determined, the cover 73 is placed on the base end portion of the flat spring 720. The cover 73 includes a retaining portion 73*a* to hold the base end portion of the cleaning blade 209. The cover 73 further includes, in an area closer to the base end than the retaining portion 73*a*, two through holes 73*b* to receive the bosses 72*e* of the flat spring 720, a rectangular slot 73*c* to prevent interference with the projections 1021*a* (the bosses) on the exterior case 1021, and screw holes for the screws 74 on both sides of the slot 73*c*.

The two screws 74 are used for the attachment of the cover 73. In the configuration in which the screw holes 81*f* are preliminarily made in the cleaning blade holder 81, the flat spring 720 and the cover 73 can be easily attached to the cleaning blade holder 81.

When the plate thickness is of the flat spring 720 is 1.0 mm or greater, the amount of engagement of the screws 74 is secured. When the plate thickness is thick, the height of the bosses 72*e* for the positioning can be increased, thus improving setting of the cover 73.

The variation described above has the following aspects.

Aspect 1

A removing device includes a residual substance remover and a flat spring to bias the residual substance remover toward an image bearer such as the photoconductor 108. According to Aspect 1, the residual substance remover is disposed in contact with the photoconductor in an inexpensive, simple structure.

Aspect 2

In the removing device according to Aspect 1, the flat spring accesses the photoconductor from a first direction identical or similar to the direction in which the cleaning blade accesses the photoconductor, and the flat spring has at least one bent position to belt from the first direction to a second direction to support the residual substance remover. According to Aspect 2, the residual substance remover is disposed in contact with the photoconductor in a direction trailing to the rotation of the photoconductor, in an inexpensive, simple structure.

Aspect 3

The removing device according to Aspect 2 further includes a cover to hold the flat spring being interposed between the cleaning blade and the cover. Aspect 3 suppresses vibration of the flat spring caused by the friction between the residual substance remover and the photoconductor.

Aspect 4

In the removing device according to Aspect 3, the cover is made of or includes an insulative resin. According to Aspect 4, even when the cover is disposed adjacent to the charging roller, electrical discharge is inhibited, thus inhibiting production of substandard images.

Aspect 5

In the removing device according to Aspect 3, the cover includes or made of a metal plate. According to Aspect 5, even when the cover is thin, the vibration of the flat spring is suppressed because the cover includes or made of metal.

Aspect 6

In the removing device according to any one of Aspects 3 through 5, the cover is screwed together with the flat spring. According to Aspect 6, the cover and the flat spring serving as the holder of the residual substance remover can be coupled with a simple structure.

Aspect 7

In the removing device according to Aspect 6, the cleaning blade holder has a plate thickness of 1.0 mm or greater and includes a screw hole into which the screw for the attachment of the cover and the flat spring is inserted. According to Aspect 7, the cover and the flat spring serving as the holder of the residual substance remover can be coupled with a simple structure.

Aspect 8

In the removing device according to any one of Aspects 3 through 7, the cleaning blade holder has an extruded boss to determine the positions of the cover and the flat spring. According to Aspect 8, the cover and the holder of the residual substance remover can be coupled with a simple structure.

Numerous additional modifications to the above-described embodiments and variations are possible. It is therefore to be understood that, within the scope of the appended claims, the disclosure of this patent specification may be practiced otherwise than as specifically described herein.

For example, the residual substance remover 71 is not limited to a rectangular plate, but the residual substance remover 71 can have a given shape. The position of the residual substance remover 71 on the photoconductor 108 is determined freely as long as the residual substance remover 71 is disposed crossing the extension line EX1 (in FIG. 4) extending from the inner end of the spacer 51 to the upstream side or downstream side in the direction of rotation of the photoconductor 108.

Additionally, the image bearer is not limited to the drum-shaped photoconductor 108 but can be shaped into an endless belt (i.e., a photoconductor belt). In this case, the photoconductor belt is entrained around a tension roller (i.e., a backup roller), and the spacer is disposed contacting the tension roller via the photoconductor belt. Then, the spacer determines the position of the optical writing head 103 relative to the photoconductor belt.

Additionally, the image bearer, the residual substance remover, and the spacer can be united together as a unit removably installed in the image forming apparatus.

What is claimed is:

1. A process unit comprising:

an image bearer to rotate and bear an electrostatic latent image and a toner image;

an optical writing head to expose a surface of the image bearer inside a maximum exposure range in an axial direction of the image bearer to form the electrostatic latent image, the maximum exposure range within a largest sheet width, within which a sheet is fed in the process unit;

a developer bearer disposed opposite the image bearer to supply toner to the image bearer, the developer bearer having a toner layer range extending beyond the largest sheet width in the axial direction;

a pair of spacers disposed in axial end portions of the image bearer and interposed between the optical writing head and the image bearer to determine a position of the optical writing head relative to the image bearer, the spacers having inner ends facing each other and positioned inside the toner layer range in the axial direction, the spacers to slidingly contact the surface of the image bearer;

a cleaner disposed downstream from the developer bearer in a rotation direction of the image bearer to remove the toner from the surface of the image bearer; and a remover disposed downstream from the cleaner in the rotation direction of the image bearer and on at least one of the axial end portions of the image bearer, the remover disposed crossing an extension line (EX1) extending from the inner end of one of the spacers in a direction perpendicular to the axial direction, the remover to slidingly contact the surface of the image bearer to remove a residual substance from the surface of the image bearer, the residual substance including the toner.

2. The process unit according to claim 1, wherein the remover is disposed outside the largest sheet width in the axial direction.

3. The process unit according to claim 1, wherein an inner end of the remover is disposed outside the maximum exposure range and inside the largest sheet width in the axial direction.

4. The process unit according to claim 1, wherein each of the spacers includes:

an inclined portion inclined relative to the axial direction and extending from the inner end of the spacer; and a linear portion extending in the rotation direction of the image bearer, the linear portion disposed outside the inclined portion in the axial direction, and wherein the remover is disposed such that an extension line (B1) crosses an inner portion of the inclined portion in the axial direction, the extension line (B1) extending toward the spacer in the rotation direction of the image bearer from an outer end of the remover in the axial direction.

5. The process unit according to claim 1, wherein the remover contains cerium oxide.

6. The process unit according to claim 1, wherein the remover is in contact with the image bearer in a direction trailing to the rotation direction of the image bearer.

7. The process unit according to claim 1, further comprising a support coupling the remover to the spacer.

8. The process unit according to claim 1, further comprising a cleaning blade holder to hold the cleaner, wherein the remover is attached to the cleaning blade holder.

9. An image forming apparatus comprising the process unit according to claim 1.

* * * * *